US011128968B2

(12) United States Patent
Andersson et al.

(10) Patent No.: US 11,128,968 B2
(45) **Date of Patent: *Sep. 21, 2021**

(54) BONE CONDUCTION SKIN INTERFACE

(71) Applicant: Cochlear Limited, Macquarie University (AU)

(72) Inventors: Marcus Andersson, MöInlycke (SE); Johan Gustafsson, MöInlycke (SE); Martin Evert Gustaf Hillbratt, MöInlycke (SE); Tobias Good, MöInlycke (SE)

(73) Assignee: Cochlear Limited, Macquarie University (AU)

( * ) Notice: Subject to any disclaimer, the term of this patent is extended or adjusted under 35 U.S.C. 154(b) by 216 days.

This patent is subject to a terminal disclaimer.

(21) Appl. No.: 15/957,227

(22) Filed: Apr. 19, 2018

(65) Prior Publication Data

US 2018/0376261 A1 Dec. 27, 2018

Related U.S. Application Data

(63) Continuation of application No. 15/164,275, filed on May 25, 2016, now Pat. No. 9,967,685.

(60) Provisional application No. 62/268,008, filed on Dec. 16, 2015.

(51) Int. Cl.
*H04R 25/00* (2006.01)

(52) U.S. Cl.
CPC ..... *H04R 25/606* (2013.01); *H04R 25/456* (2013.01); *H04R 2460/13* (2013.01)

(58) Field of Classification Search
CPC ..... H04R 2460/13; H04R 25/606; H04R 2225/67; H04R 25/456
See application file for complete search history.

(56) References Cited

U.S. PATENT DOCUMENTS

2011/0019851 A1 1/2011 Michel et al.
2015/0049889 A1* 2/2015 Bern ..... H04R 25/456 381/312
2015/0281860 A1* 10/2015 Johansson ..... H04R 25/606 381/326

OTHER PUBLICATIONS

Extended European Search Report for EP Application No. 16 875 030.5, dated Jul. 9, 2019.

* cited by examiner

*Primary Examiner* — Matthew A Eason
(74) *Attorney, Agent, or Firm* — Pilloff Passino & Cosenza LLP; Martin J. Cosenza

(57) ABSTRACT

A skin interface apparatus configured as an interface of a prosthesis with skin of a recipient, including a first portion configured for direct contact with skin of the recipient, and a second portion configured for direct contact with skin of the recipient, wherein the portions have different material properties. In an exemplary embodiment, the first portion is a part of a holding plate pad of a hearing prosthesis and the second portion is part of a driving plate pad of the hearing prosthesis.

20 Claims, 39 Drawing Sheets

BONE CONDUCTION SKIN INTERFACE

CROSS-REFERENCE TO RELATED APPLICATIONS

This application is a Continuation Application of U.S. patent application Ser. No. 15/164,275, filed May 25, 2016, which claims priority to Provisional U.S. Patent Application No. 62/268,008, entitled BONE CONDUCTION SKIN INTERFACE, filed on Dec. 16, 2015, naming Marcus ANDERSSON of Molnlycke, Sweden as an inventor, the entire contents of each application being incorporated herein by reference in their entirety.

BACKGROUND

Hearing loss, which may be due to many different causes, is generally of two types: conductive and sensorineural. Sensorineural hearing loss is due to the absence or destruction of the hair cells in the cochlea that transduce sound signals into nerve impulses. Various hearing prostheses are commercially available to provide individuals suffering from sensorineural hearing loss with the ability to perceive sound. For example, cochlear implants use an electrode array implanted in the cochlea of a recipient to bypass the mechanisms of the ear. More specifically, an electrical stimulus is provided via the electrode array to the auditory nerve, thereby causing a hearing percept.

Conductive hearing loss occurs when the normal mechanical pathways that provide sound to hair cells in the cochlea are impeded, for example, by damage to the ossicular chain or the ear canal. Individuals suffering from conductive hearing loss may retain some form of residual hearing because the hair cells in the cochlea may remain undamaged.

Individuals suffering from conductive hearing loss typically receive an acoustic hearing aid. Hearing aids rely on principles of air conduction to transmit acoustic signals to the cochlea. In particular, a hearing aid typically uses an arrangement positioned in the recipient's ear canal or on the outer ear to amplify a sound received by the outer ear of the recipient. This amplified sound reaches the cochlea causing motion of the perilymph and stimulation of the auditory nerve.

In contrast to hearing aids, which rely primarily on the principles of air conduction, certain types of hearing prostheses commonly referred to as bone conduction devices, convert a received sound into vibrations. The vibrations are transferred through the skull to the cochlea causing generation of nerve impulses, which result in the perception of the received sound. Bone conduction devices are suitable to treat a variety of types of hearing loss and may be suitable for individuals who cannot derive sufficient benefit from acoustic hearing aids, cochlear implants, etc., or for individuals who suffer from stuttering problems.

SUMMARY

In accordance with one aspect, there is an interface apparatus configured as an interface of a prosthesis with skin of a recipient, comprising a first portion configured for direct contact with skin of the recipient, and a second portion configured for direct contact with skin of the recipient, wherein the portions have different material properties.

In accordance with another exemplary embodiment, there is an interface assembly for an external component of a bone conduction device, comprising a support assembly, and a drive assembly, wherein the support assembly is configured to react against at least substantially all of a retention force between the external component and skin of a recipient of the bone conduction device, the driving assembly is configured to vibrate in response to sound captured by the external component of the bone conduction device, and the support assembly includes a first removable skin interface pad and the driving assembly includes a second removable skin interface pad.

In accordance with another exemplary embodiment, there is a skin interface pad assembly for an external component of a passive bone conduction device, comprising a first pad portion configured to interface with skin of the recipient, and a second pad portion configured to interface with skin of the recipient, wherein the first pad portion is made of different material than the second pad portion.

In accordance with another exemplary embodiment, there is a removable component of a bone conduction device, comprising a first skin interface apparatus configured to serve as an interface between a support apparatus of the device and skin of a recipient, and a second skin interface apparatus configured to serve as an interface between a vibratory apparatus of the device and skin of the recipient, wherein the skin interface apparatuses are different.

In accordance with another exemplary embodiment, there is a method of using a hearing prosthesis, comprising transducing a captured sound signal into mechanical vibrations using an external component of the hearing prosthesis, and transferring the mechanical vibrations into skin of a recipient, thereby evoking a hearing percept, wherein a path of the transduced vibrations travels from the external component into the skin through a first surface that has a different characteristic than a second surface supporting the external component on the skin.

BRIEF DESCRIPTION OF THE DRAWINGS

Some embodiments are described below with reference to the attached drawings, in which:

FIGS. 8-9A are schematic diagrams illustrating other exemplary skin interface assemblies according to some other exemplary embodiments;

DETAILED DESCRIPTION

Figure 1:
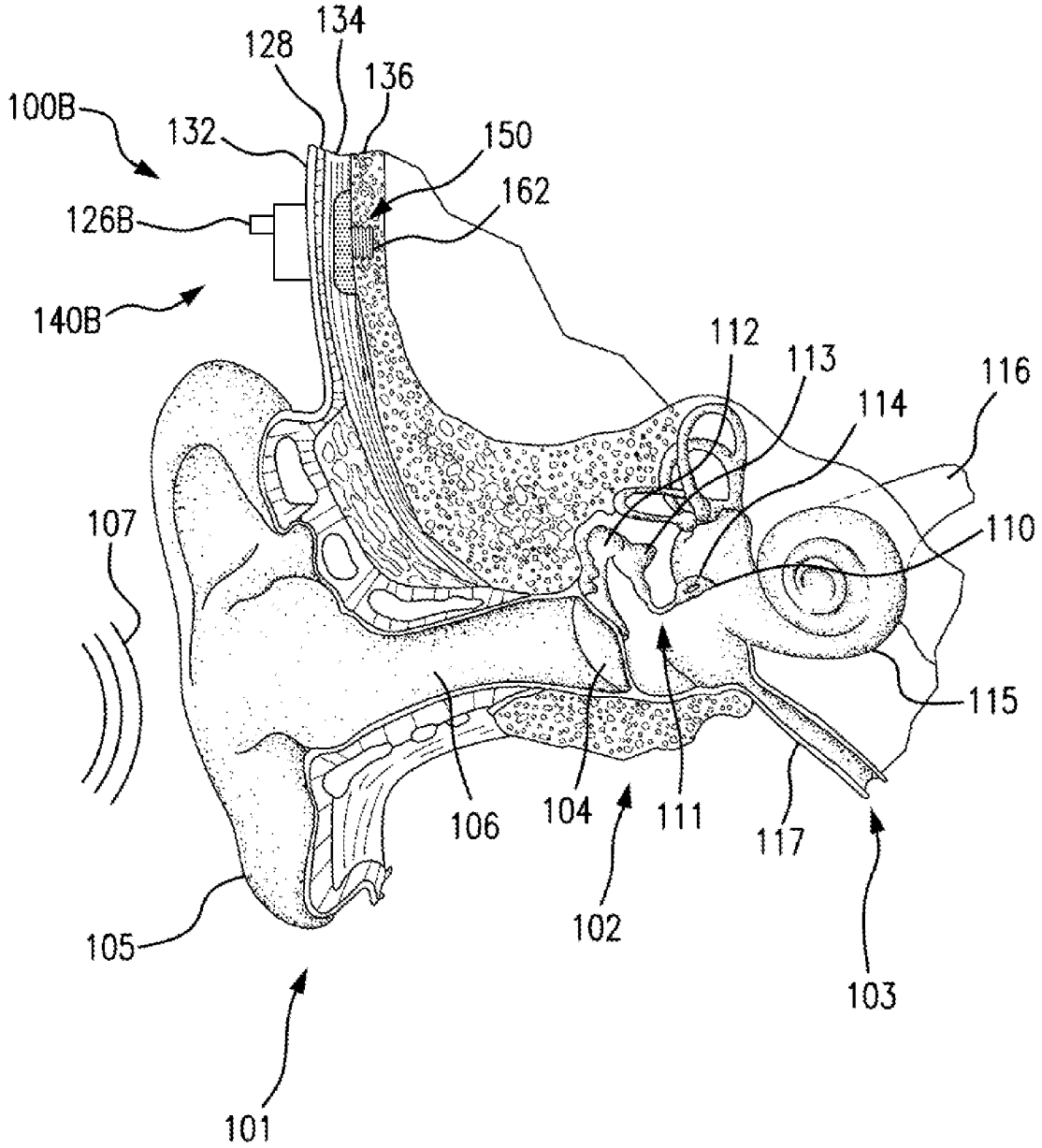
FIG. 1 is a perspective view of an exemplary bone conduction device in which at least some embodiments can be implemented.

FIG. 1 is a perspective view of a bone conduction device 100 in which embodiments may be implemented. As shown, the recipient has an outer ear 101, a middle ear 102 and an inner ear 103. Elements of outer ear 101, middle ear 102 and inner ear 103 are described below, followed by a description of bone conduction device 100.

In a fully functional human hearing anatomy, outer ear 101 comprises an auricle 105 and an ear canal 106. A sound wave or acoustic pressure 107 is collected by auricle 105 and channeled into and through ear canal 106. Disposed across the distal end of ear canal 106 is a tympanic membrane 104 which vibrates in response to acoustic wave 107. This vibration is coupled to oval window or fenestra ovalis 210 through three bones of middle ear 102, collectively referred to as the ossicles 111 and comprising the malleus 112, the incus 113 and the stapes 114. The ossicles 111 of middle ear 102 serve to filter and amplify acoustic wave 107, causing oval window to vibrate. Such vibration sets up waves of fluid motion within cochlea 139. Such fluid motion, in turn, activates hair cells (not shown) that line the inside of cochlea 139. Activation of the hair cells causes appropriate nerve impulses to be transferred through the spiral ganglion cells and auditory nerve 116 to the brain (not shown), where they are perceived as sound.

FIG. 1 also illustrates the positioning of bone conduction device 100 relative to outer ear 101, middle ear 102 and inner ear 103 of a recipient of device 100. As shown, bone conduction device 100 is positioned behind outer ear 101 of the recipient and comprises a sound input element 126 to receive sound signals. Sound input element may comprise, for example, a microphone, telecoil, etc. In an exemplary embodiment, sound input element 126 may be located, for example, on or in bone conduction device 100, or on a cable extending from bone conduction device 100.

The bone conduction device 100 of FIG. 1 is a passive transcutaneous bone conduction device utilizing the electromagnetic actuators disclosed herein and variations thereof where no active component (e.g., the electromagnetic actuator) is implanted beneath the skin (it is instead located in an external device), and the implantable part is, for instance a magnetic pressure plate (a permanent magnet, ferromagnetic material, etc.). Some embodiments of the passive transcutaneous bone conduction systems are configured for use where the vibrator (located in an external device) containing the electromagnetic actuator is held in place by pressing the vibrator against the skin of the recipient. In an exemplary embodiment, the vibrator is held against the skin via a magnetic coupling (magnetic material and/or magnets being implanted in the recipient and the vibrator having a magnet and/or magnetic material that is used to complete the magnetic circuit, thereby coupling the vibrator to the recipient).

More specifically, FIG. 1 is a perspective view of a passive transcutaneous bone conduction device 100 in which embodiments can be implemented.

Bone conduction device 100 comprises an external component 140 and an implantable component 150. Bone conduction device 100 comprises a sound processor (not shown), an actuator (also not shown) and/or various other operational components. In operation, sound input device 126 converts received sounds into electrical signals. These electrical signals are utilized by the sound processor to generate control signals that cause the actuator to vibrate. In other words, the actuator converts the electrical signals into mechanical vibrations for delivery to the recipient's skull.

In accordance with some embodiments, a fixation system 162 may be used to secure implantable component 150 to skull 136. As described below, fixation system 162 may be a bone screw fixed to skull 136, and also attached to implantable component 150.

In one arrangement of FIG. 1, bone conduction device 100 is a passive transcutaneous bone conduction device. In such an arrangement, the actuator is located in external component 140, and implantable component 150 includes a plate, as will be discussed in greater detail below. The plate of the implantable component 150 vibrates in response to vibrations transmitted through the skin, mechanically and/or via a magnetic field, that are generated by an external magnetic plate.

Figure 2:
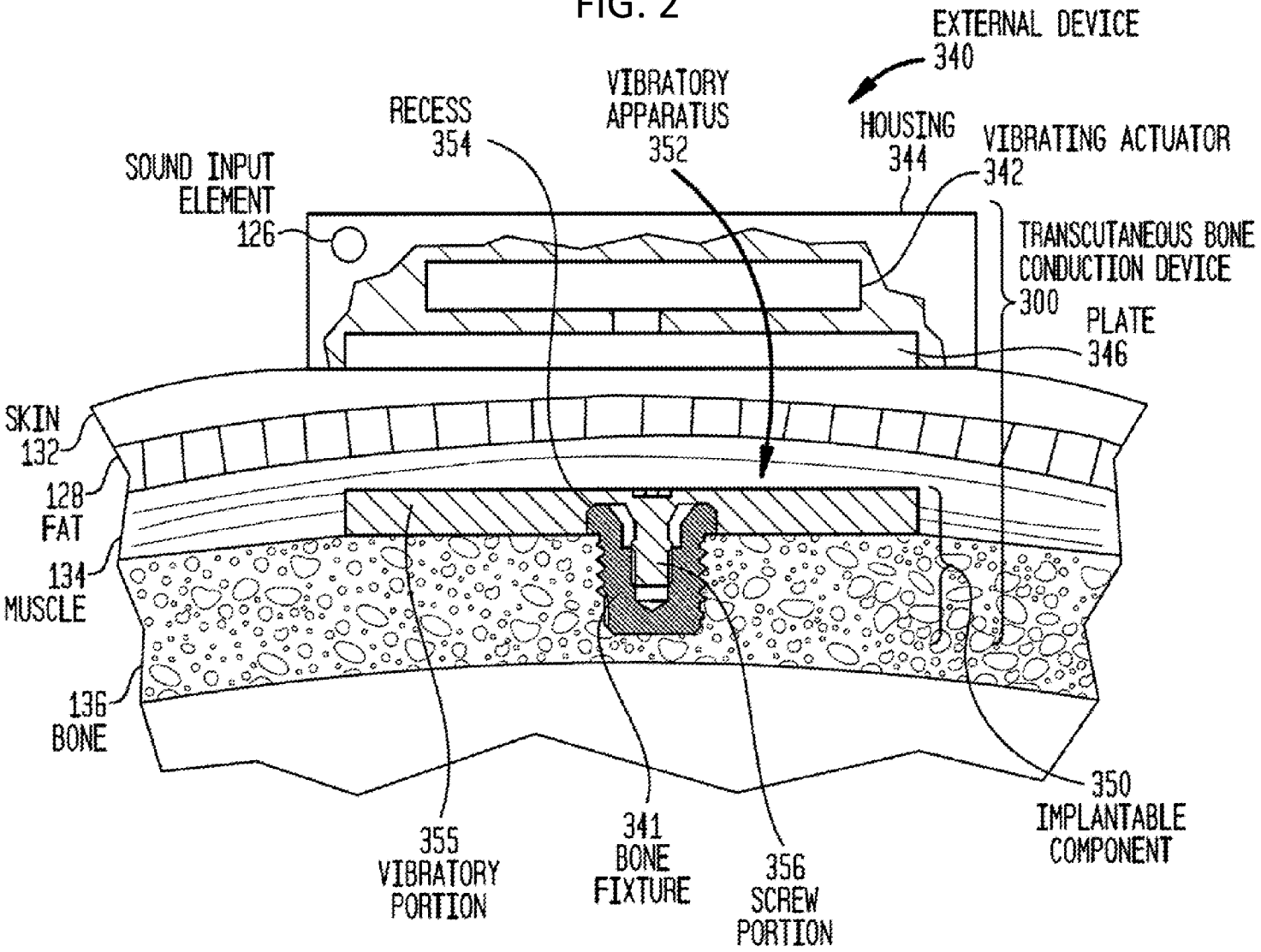
FIG. 2 is a schematic diagram conceptually illustrating a passive transcutaneous bone conduction device in accordance with at least some exemplary embodiments.

FIG. 2 depicts a functional schematic of an exemplary embodiment of a transcutaneous bone conduction device 300 according to an embodiment that includes an external device 340 (corresponding to, for example, element 140 of FIG. 1) and an implantable component 350 (corresponding to, for example, element 150 of FIG. 1). The transcutaneous bone conduction device 300 of FIG. 2 is a passive transcutaneous bone conduction device in that a vibrating electromagnetic actuator 342 is located in the external device 340. Vibrating electromagnetic actuator 342 is located in housing 344 of the external component, and is coupled to plate 346. In an exemplary embodiment, the vibrating electromagnetic actuator 342 is a device that converts electrical signals into vibration. In operation, sound input element 126 converts sound into electrical signals. Specifically, the transcutaneous bone conduction device 300 provides these electrical signals to vibrating actuator 342, or to a sound processor (not shown) that processes the electrical signals, and then provides those processed signals to vibrating electromagnetic actuator 342. The vibrating electromagnetic actuator 342 converts the electrical signals (processed or unprocessed) into vibrations. Because vibrating electromagnetic actuator 342 is mechanically coupled to plate 346, the vibrations are transferred from the vibrating actuator 342 to plate 346. Implanted plate assembly 352 is part of the implantable component 350, and is made of a ferromagnetic material that may be in the form of a permanent magnet, that generates and/or is reactive to a magnetic field, or otherwise permits the establishment of a magnetic attraction between the external device 340 and the implantable component 350 sufficient to hold the external device 340 against the skin of the recipient, as will be detailed further below. Accordingly, vibrations produced by the vibrating electromagnetic actuator 342 of the external device 340 are transferred from plate 346 across the skin to plate 355 of implanted plate assembly 352. This can be accomplished as a result of mechanical conduction of the vibrations through the skin, resulting from the external device 340 being in direct contact with the skin and/or from the magnetic field between the two plates. These vibrations are transferred without penetrating the skin with a solid object such as an abutment, as detailed herein with respect to a percutaneous bone conduction device.

As may be seen, the implanted plate assembly 352 is substantially rigidly attached to a bone fixture 341 in this embodiment. Plate screw 356 is used to secure plate assembly 352 to bone fixture 341. The portions of plate screw 356 that interface with the bone fixture 341 substantially correspond to an abutment screw discussed in some additional detail below, thus permitting plate screw 356 to readily fit into an existing bone fixture used in a percutaneous bone conduction device. In an exemplary embodiment, plate screw 356 is configured so that the same tools and procedures that are used to install and/or remove an abutment screw (described below) from bone fixture 341 can be used to install and/or remove plate screw 356 from the bone fixture 341 (and thus the plate assembly 352).

Figure 3A:
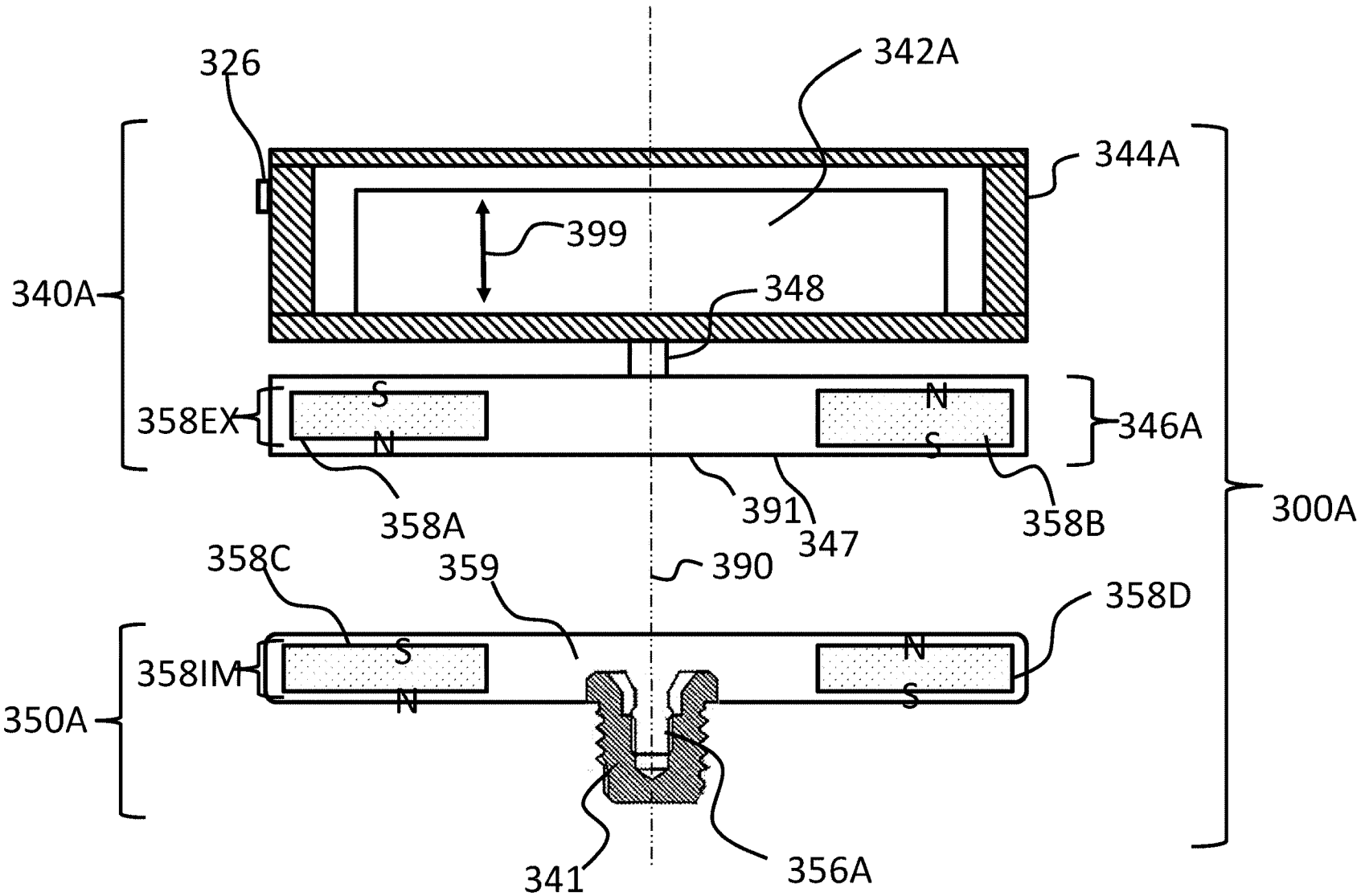
FIGS. 3A and 3B are schematic diagrams illustrating additional details of the embodiment of FIG. 2.

Referring now to FIG. 3A, there is depicted a schematic of an exemplary bone conduction device 300A corresponding to bone conduction device 300 of FIG. 2. The exemplary bone conduction device 300A of FIG. 3 includes an external component 340A corresponding to external component 340 of FIG. 2, and an implantable component 350A corresponding to implantable component 350 of FIG. 2.

In an exemplary embodiment, external component 340A has the functionality of a transducer/actuator, irrespective of whether it is used with implantable component 350A. That is, in some exemplary embodiments, external component 340A will vibrate whether or not the implantable component 350A is present (e.g., whether or not the static magnetic field extends to the implantable component 350A, as will be detailed below).

The external component 340A includes a vibrating actuator represented in black-box format by reference numeral 342A. In an exemplary embodiment, the vibrating actuator can be an electromagnetic actuator. Alternatively, in some alternate embodiments, the vibrating actuator 342A can be a piezoelectric actuator. Any type of actuator that can enable the teachings detailed herein and/or variations thereof to be practiced can be utilized in at least some exemplary embodiments. That said, embodiments detailed herein will be described, by way of example only and not by way of limitation, in terms of a vibrating electromagnetic actuator that utilizes a yoke about which is wound a coil that is energized and deenergized in an alternating manner so as to produce an electromagnetic field that interacts with permanent magnets that move a seismic mass in a reciprocating vibratory matter in a direction of arrow 399.

Still with reference to FIG. 3A, the vibrating electromagnetic actuator 342A is enclosed in a housing 344A, as can be seen. In some embodiments, the housing 344A is a hermetically sealed housing, while in other embodiments, it is not hermetically sealed. In at least some exemplary embodiments, the housing 344A is configured to provide the actuator 342A protection from shock and environmental conditions, etc. Any housing that can enable the teachings detailed herein and/or variations thereof can be utilized in at least some embodiments. In this regard, as can be seen, the housing 344A is rigidly attached to skin interface assembly 346A, which functionally corresponds to plate 346 of FIG. 2 detailed above, by structural component 348. In this exemplary embodiment, the structural component 348 provides a vibrational conduction path such that vibrations generated by actuator 342A are transferred from the housing to the skin interface component 346A such that those vibrations can then be transferred into the skin of the recipient to ultimately evoke a hearing percept according to the teachings detailed herein and/or variations thereof.

In at least some embodiments, skin interface assembly 346A serves a dual role in that it both transfers vibrations from the external component 340A to the skin and also magnetically couples the external component 340A to the recipient. In this regard, as can be seen, skin interface assembly 346A includes a housing 347 that includes an external magnet assembly 358EX. External magnetic assembly 358EX includes permanent magnets having a North-South alignment. These magnets are locationally adjustable relative to one another, as will be detailed below. However, in the configuration depicted in FIG. 3A, the magnet on one side of the magnetic assembly 358EX, relative to the longitudinal axis 390 of the bone conduction device 300A, has a North pole facing towards the actuator 342A (i.e., away from the skin of the recipient), and the magnet on the other side of the magnetic assembly 358EX, relative to longitudinal axis 390 of the bone conduction device, has its North pole facing away from the actuator 342A (i.e., towards the skin of the recipient). That is, the North-South alignment of one side of the external magnet assembly 358EX is opposite that of the other side of the assembly. However, in some exemplary embodiments, the external component 340A is configured such that the individual magnets can be moved so that the poles are different than that depicted in FIG. 3A. Still further, in some exemplary embodiments, the North-South axis is perpendicular to the axis 390. Any arrangement of magnet that can enable the teachings detailed herein can be utilized in at least some embodiments.

Additional details of external magnet assembly 358EX are presented below.

Skin interface assembly 346A includes a bottom surface 391 (relative to the frame of reference of FIG. 3A) that is configured to interface with the exterior skin of the recipient, at least from a conceptual standpoint. As will be detailed below, in some embodiments, the components of the bone conduction devices are utilized such that the surface 391 is in direct contact with skin of the recipient, while in other embodiments, a skin interface apparatus is located between surface 391 and the skin of the recipient. For the purposes of discussion at this point, the surface 391 will be considered to interface directly with the skin of the recipient. Thus, in this regard, skin interface assembly 346A corresponds to plate 346 of FIG. 2 as described above. It is through skin interface assembly 346A that vibrations generated by the electromagnetic actuator of the external component 340A are transferred from the external component 340A to the skin of the recipient to evoke a hearing percept. In an exemplary embodiment, the housing 347 of the skin interface assembly 346A is made of a non-ferromagnetic material that is compatible with skin of the recipient (or at least is coated with a material that is compatible with skin of the recipient). In this regard, in at least some exemplary embodiments, the housing 347 is configured to substantially avoid influencing the magnetic flux generated by the permanent magnets of the external magnet assembly 358EX.

FIG. 3A also depicts an implantable component 350A corresponding to implantable component 350 of FIG. 2. In some embodiments, implantable component 350 includes an implantable magnet assembly 358IM that includes at least two permanent magnets 358C and 358D. Permanent magnet 358C has a North-South alignment in a first direction relative to a longitudinal axis of the electromagnetic actuator (the vertical direction of FIG. 3). Permanent magnet 358D has a North-South alignment in a second direction relative to a longitudinal axis of the electromagnetic actuator, the second direction being opposite the first direction. In an exemplary embodiment, the permanent magnets are bar magnets (having a longitudinal direction extending normal to the plane of FIG. 3). In at least some exemplary embodiments, permanent magnets 358C and 358D are bar magnets connected to one another via the chassis 359 of the implantable component 350A. In an exemplary embodiment, the chassis 359 is a nonmagnetic material (e.g., titanium). It is noted that in alternative embodiments, other configurations of magnets can be utilized. Any configuration of a permanent magnet assembly that can enable the teachings detailed herein and/or variations thereof to be practiced can be utilized in at least some embodiments.

That said, in an alternative embodiment, it is noted that the implantable component 350A does not include permanent magnets. In at least some embodiments, elements 358C and 358D are replaced with other types of ferromagnetic material (e.g., soft iron (albeit encapsulated in titanium, etc.)). Also, elements 358C and 358D can be replaced with a single, monolithic component. Any configuration of ferromagnetic material of the implantable component 350A that will enable the permanent magnets of the external component 340A to establish a magnetic coupling with the implantable component 350A that will enable the external component 340A to be adhered to the surface of the skin, as detailed herein, can be utilized in at least some embodiments.

As can be seen, implantable component 350A includes screw component 356A configured to screw into bone fixture 341 and thus secure the chassis 359 to the bone fixture 341, and thus to the recipient.

Referring back to the external component 340A, and, more particularly, to the external magnetic assembly 358EX of the skin interface assembly 346A, it can be seen that the external magnetic assembly 358EX comprises two (2) magnets arrayed about the longitudinal axis 390, although in other embodiments, fewer or more magnets can be utilized. External magnetic assembly 358EX includes magnet 358A and magnet 358B.

Figure 3B:
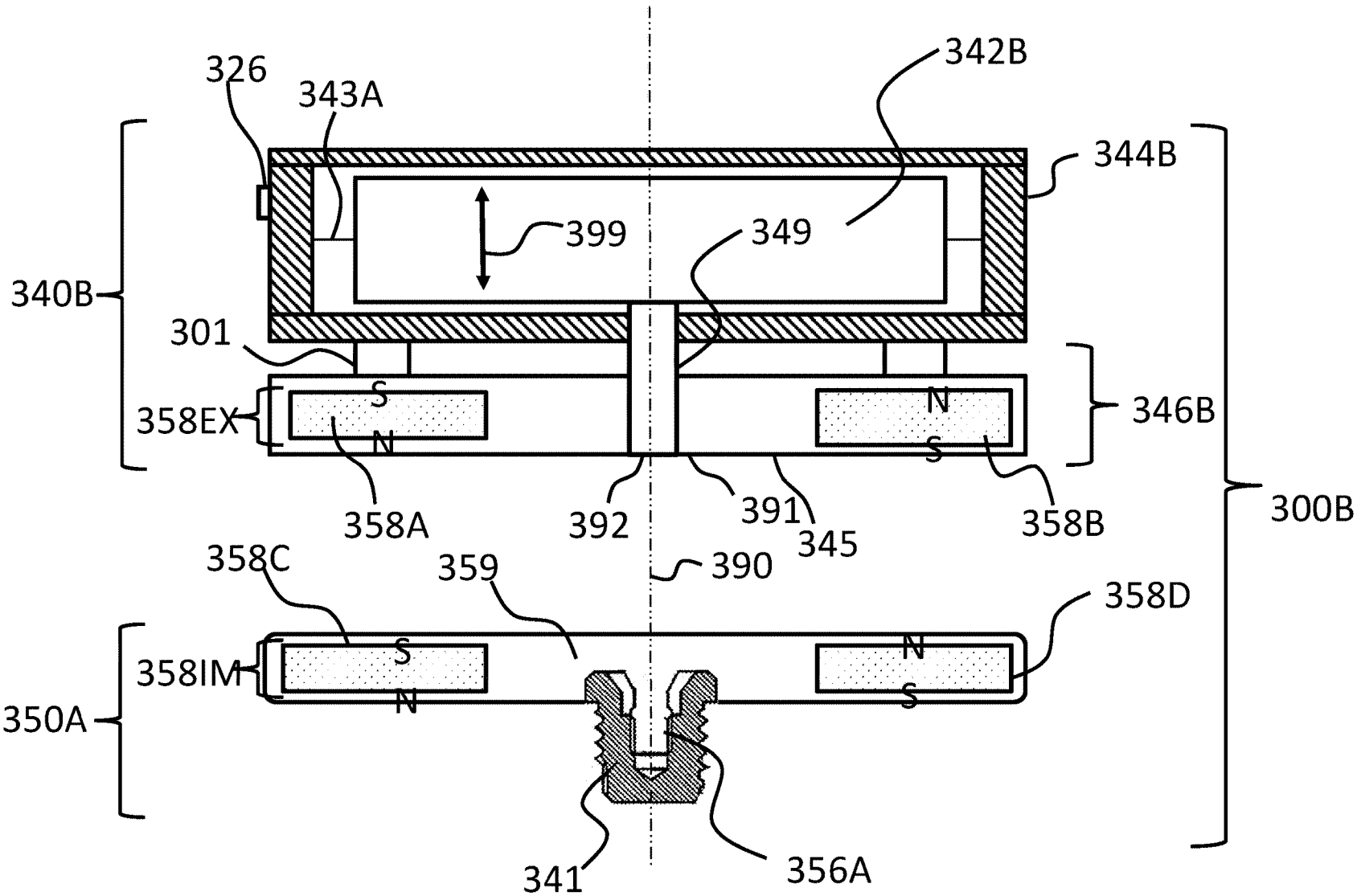

Referring now to FIG. 3B, there is depicted a schematic of an exemplary bone conduction device 300B corresponding in general terms to bone conduction device 300 of FIG. 2, albeit with some functional differences. The exemplary bone conduction device 300B of FIG. 3B includes an external component 340B corresponding to external component 340 of FIG. 2, and an implantable component 350A corresponding to implantable component 350 of FIG. 2.

In an exemplary embodiment, external component 340B has the functionality of a transducer/actuator, irrespective of whether it is used with implantable component 350A. That is, in some exemplary embodiments, external component 340B will vibrate whether or not the implantable component 350A is present (e.g., whether or not the static magnetic field extends to the implantable component 350A, as will be detailed below).

The external component 340B includes a vibrating actuator represented in black-box format by reference numeral 342B. In an exemplary embodiment, the vibrating actuator can be an electromagnetic actuator. Alternatively, in some alternate embodiments, the vibrating actuator 342B can be a piezoelectric actuator. Any type of an actuator that can enable the teachings detailed herein and/or variations thereof to be practiced can be utilized in at least some exemplary embodiments. That said, embodiments detailed herein will be described, by way of example only and not by way of limitation, in terms of a vibrating electromagnetic actuator that utilizes a yoke about which is wound a coil that is energized and deenergized in an alternating manner so as to produce an electromagnetic field that interacts with permanent magnets that moves a seismic mass in a reciprocating vibratory matter in a direction of arrow 399.

Still with reference to FIG. 3B, the vibrating electromagnetic actuator 342B is enclosed in a housing 344B, as can be seen. In some embodiments, the housing 344B is a hermetically sealed housing, while in other embodiments, it is not hermetically sealed. In at least some exemplary embodiments, the housing 344B is configured to provide the actuator 342B protection from shock and environmental conditions, etc. Any housing that can enable the teachings detailed herein and/or variations thereof can be utilized in at least some embodiments. Actuator 342B is supported in the housing by spring 343A (this can also be the case in the embodiment of FIG. 3A).

The housing 344B is attached to skin interface assembly 346B by pillar(s) 301. Pillars 301 support most (including all) of the weight of the external component 340B above the skin interface assembly 346B. However, in this exemplary embodiment, a separate vibrational path from the actuator 342B exists via structural component 349, which extends from the actuator 342B, through the housing wall of the housing 344B, through the housing 345 of the skin interface assembly 346B, which corresponds to housing 347 of FIG. 3A in that it includes the external magnet assembly 358EX. Thus, the bottom of the skin interface assembly 346B is made up of the bottom of the housing 345 and the bottom of the structural component 349 (which can be a cylinder of titanium, or stainless, steel, or a cylinder of a polymer, etc.). Collectively, housing 349 and cylinder 348 functionally correspond to plate 346 of FIG. 2 detailed above. In this exemplary embodiment, the structural component 349 provides a vibrational conduction path such that vibrations generated by actuator 342A are transferred from the housing to the skin interface component 346B such that those vibrations can then be transferred into the skin of the recipient to ultimately evoke a hearing percept according to the teachings detailed herein and/or variations thereof.

In at least some embodiments, skin interface assembly 346B serves a dual role in that it both transfers vibrations from the external component 340A to the skin and also magnetically couples the external component 340A to the recipient. In this regard, as can be seen, skin interface assembly 346A includes the housing 345 that includes an external magnet assembly 358EX. The arrangement of magnets can correspond to any such arrangement usable in the embodiment of FIG. 3A, along with other variations.

Skin interface assembly 346B includes a bottom surface 392 (relative to the frame of reference of FIG. 3B) that is a combination of the bottom surface 391 of the housing 345 and the bottom surface 392 of the structural component 349 that is configured to interface with the exterior skin of the recipient. However, again as will be detailed below, in some embodiments, the components of the bone conduction devices are utilized such that the surface 392 and the surface 393 are in direct contact with skin of the recipient, while in other embodiments, a skin interface apparatus is located between surface 392 and/or surface 393 on the one hand, and the skin of the recipient on the other. For the purposes of discussion at this point, the surfaces 391 and 392 will be considered to interface directly with the skin of the recipient. Thus, in this regard, skin interface assembly 346B corresponds to plate 346 of FIG. 2 as described above. In this regard, skin interface assembly 346B functionally corresponds to plate 346 of FIG. 2 as described above. It is through skin interface assembly 346B that vibrations generated by the electromagnetic actuator of the external component 340B are transferred from the external component 340B to the skin of the recipient to evoke a hearing percept. It is noted that in some embodiments, there is no external magnet assembly 358EX and/or implantable magnet assembly 358IM. By way of example only and not by way of limitation, in an exemplary embodiment, the removable component 340A and/or 340B can be held against the skin of the recipient by a non-magnetic apparatus. Such an exemplary non-magnetic apparatus can include a so-called soft band that extends about the head of the recipient and presses the removable component 340A and/or 340B against the skin. Still further by way of example, such an exemplary nonmagnetic apparatus can include a so-called counseling arch that extends about at least a portion of the head of the recipient and applies a clamping pressure on the head of the recipient, thereby holding the removable component against the skin of the recipient. Any arrangement that can be utilized to hold the removable component against the skin of the recipient can be utilized in at least some exemplary embodiments.

While the embodiments depicted in FIGS. 3A and 3B are presented in terms of the bottom surface 391 and 392 and 393 being configured for direct contact with skin of the recipient, in some exemplary embodiments, there is an additional component located between the aforementioned surfaces and the skin of the recipient. By way of example only and not by way of limitation, in an exemplary embodiment, the skin interface assembly can include a skin interface apparatus, such as a skin interface apparatus in the form of a pad (or pad assembly, as will be describe below), such as a soft pad that is adhered to the aforementioned surfaces.

It is noted that at this time, some of the teachings detailed herein are directed towards pads. Any disclosure herein directed towards a pad also corresponds to a disclosure of a non-pad component unless otherwise stated. Corollary to this is that any disclosure herein to a component utilizing a generic term, such as "component," or "apparatus," etc., corresponds to a disclosure applicable to a pad.

Figure 4A:
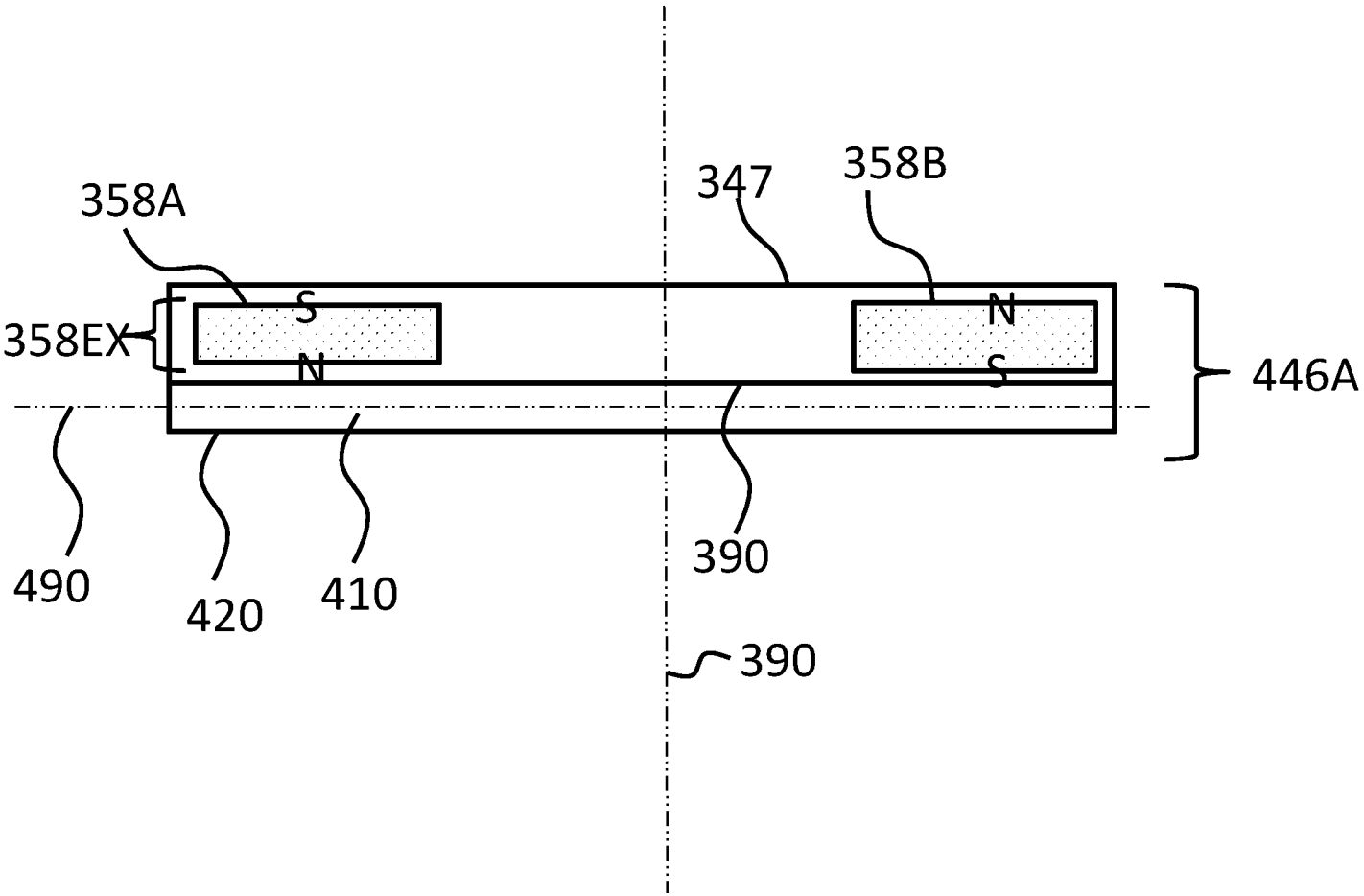
FIGS. 4A-4B are schematic diagrams illustrating exemplary skin interface assemblies according to some exemplary embodiment.
Figure 4B:
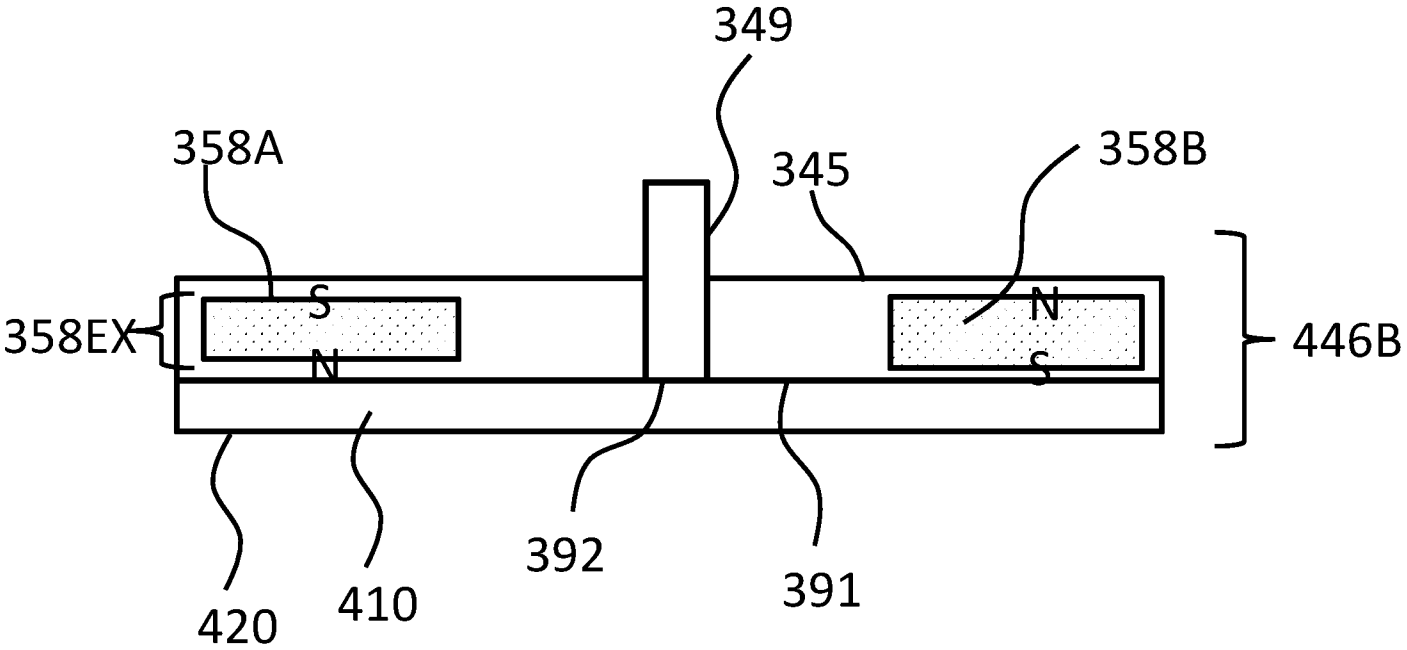

FIG. 4A presents an exemplary embodiment of a skin interface assembly 446A that can correspond to the skin interface assembly 346A. As seen in FIG. 4A, a pad 410 is located on surface 391. Pad 410 includes skin interface surface 420. In an exemplary embodiment, the vibrations generated by the given actuator are transferred to the skin interface assembly 446A which are then transferred through the pad 410 and thus through the surface 420 into the skin of the recipient. In this regard, the skin interface assembly 446A functionally corresponds to the plate 346 of FIG. 2. FIG. 4B presents an alternate embodiment of a skin interface assembly, skin interface assembly 446B, that includes the features of the embodiment of FIG. 3B detailed above, but where the pad 410 is located against the bottom surface 391 and the bottom surface 392. In an exemplary embodiment, the vibrations generated by the given actuator are transferred to the skin interface assembly 446B along the structural component 349 and then transferred into pad 410, and through pad 410 and thus through the surface 420 into the skin of the recipient.

In the embodiments of FIGS. 4A and 4B, the pad 410 is a pad having uniform properties (e.g., material properties) and uniform features over its entire length and width. There are no non-material property discontinuities (e.g., assuming arguendo that the cells in a foam are discontinuities, those are a material property discontinuity) of the pad 410 in a plane, such as plane 490, extending normal to the longitudinal axis 390 (although it is possible that there is such on a plane parallel thereto—this feature is limited to only one plane). Further, in the embodiments of FIGS. 4A and 4B, there are no non-material property discontinuities in at least one plane extending parallel to the longitudinal axis 390 and lying thereon. Indeed, in these embodiments, there are no non-material property discontinuities in any plane extending parallel to the longitudinal axis 390 and lying thereon. That said, in some embodiments of FIGS. 4A and 4B, the properties at the borders of the pad 410 might not necessarily meet the aforementioned features (e.g., the pad could be contained in a skin or the like, a protective surface can be located on the bottom so as to improve the longevity of the pad, etc.). Thus, in some embodiments, the aforementioned features are with respect to locations inboard of the boundaries of the pad 410. By way of example, the aforementioned features are features present within an area that is bordered within at least 5 or 10 or 20 percent of a respective diameter from the outer border of the pad 410 (e.g., for a given diameter, border points of the aforementioned locations lying on the diameter will be 2.5% or 5% or 10% of the total diameter from the respective outer border).

Figure 5A:
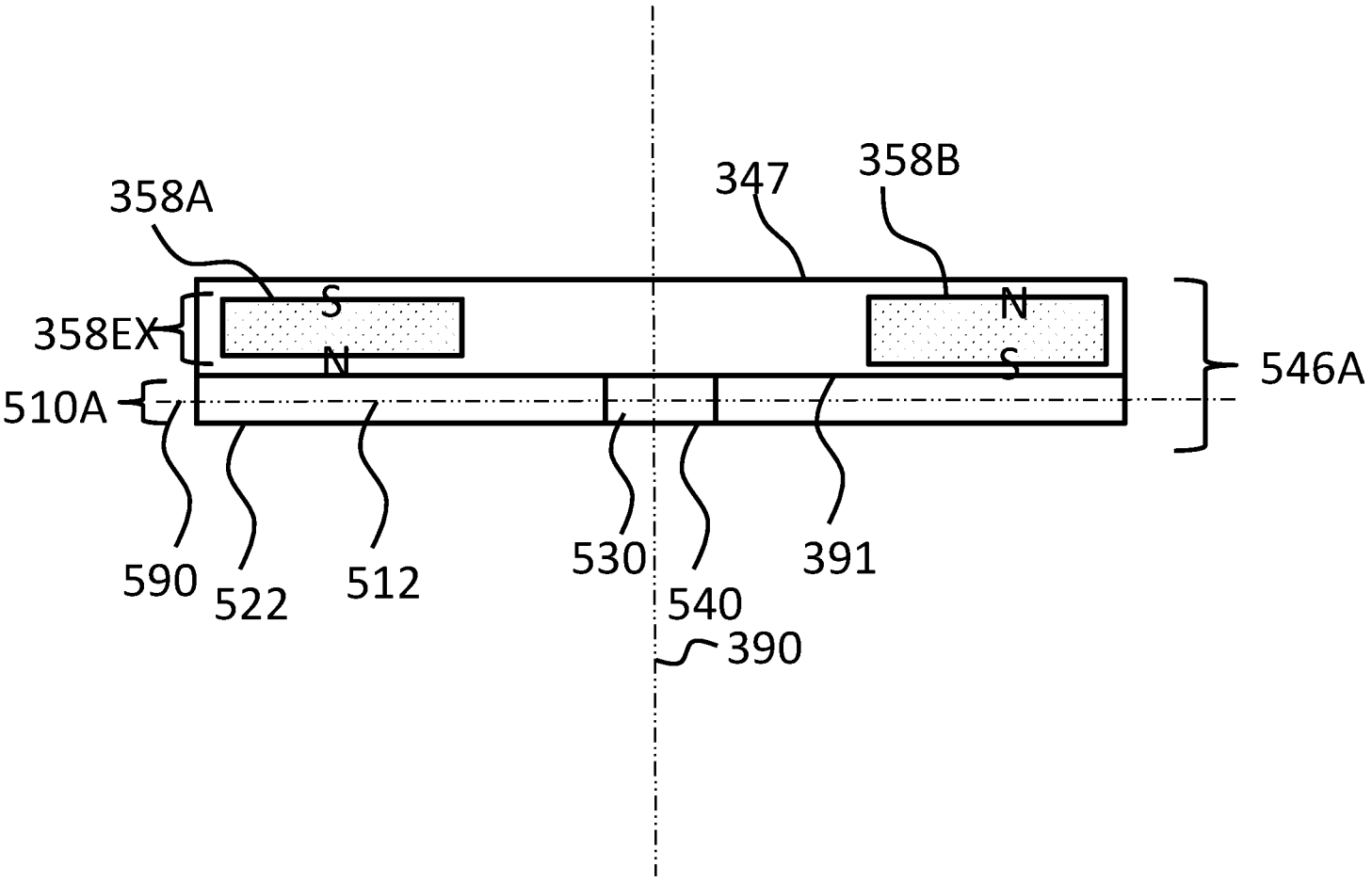
FIGS. 5A-C are schematic diagrams illustrating other exemplary skin interface assemblies according to some other exemplary embodiments.
Figure 5B:
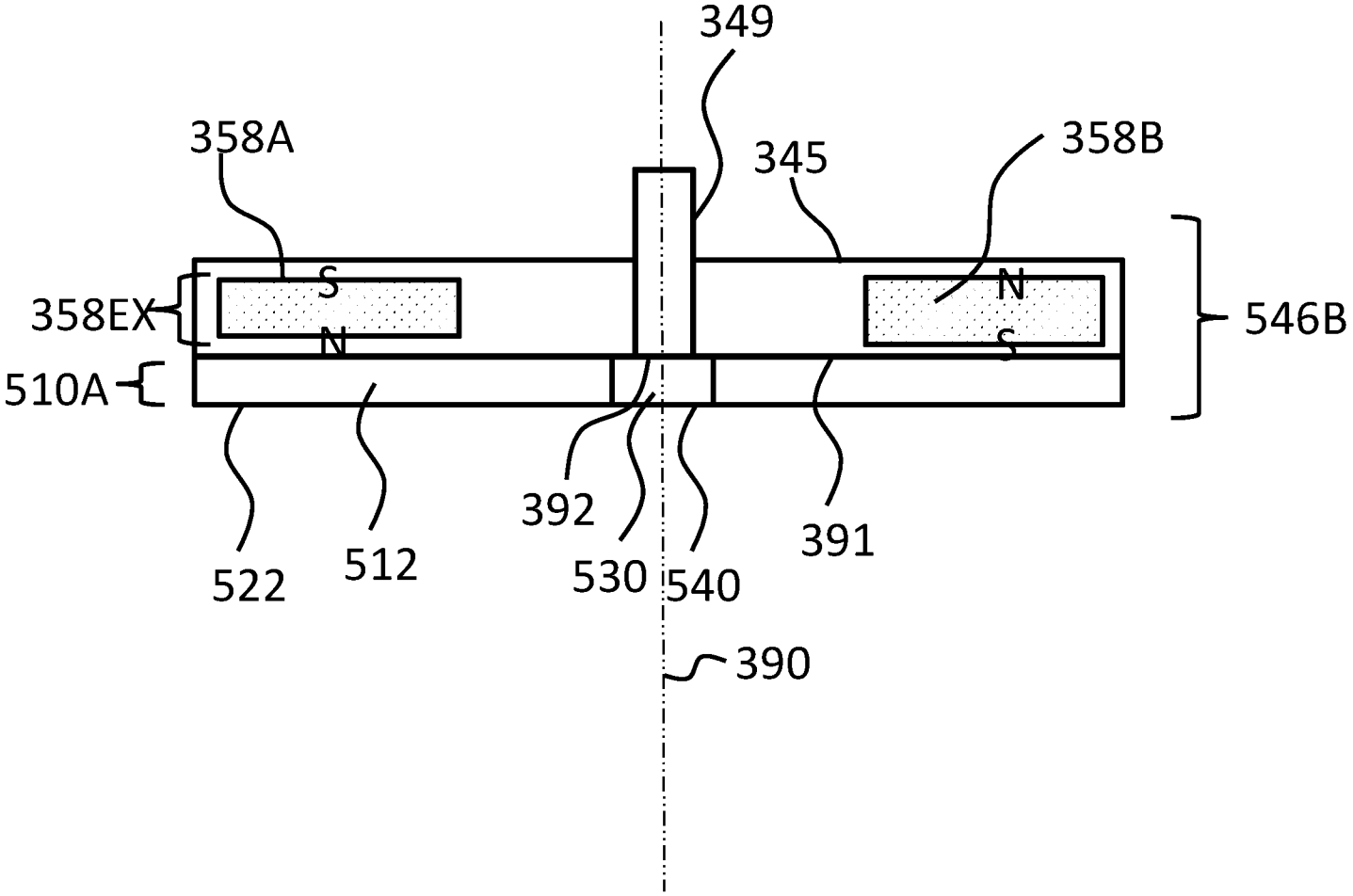
Figure 5C:
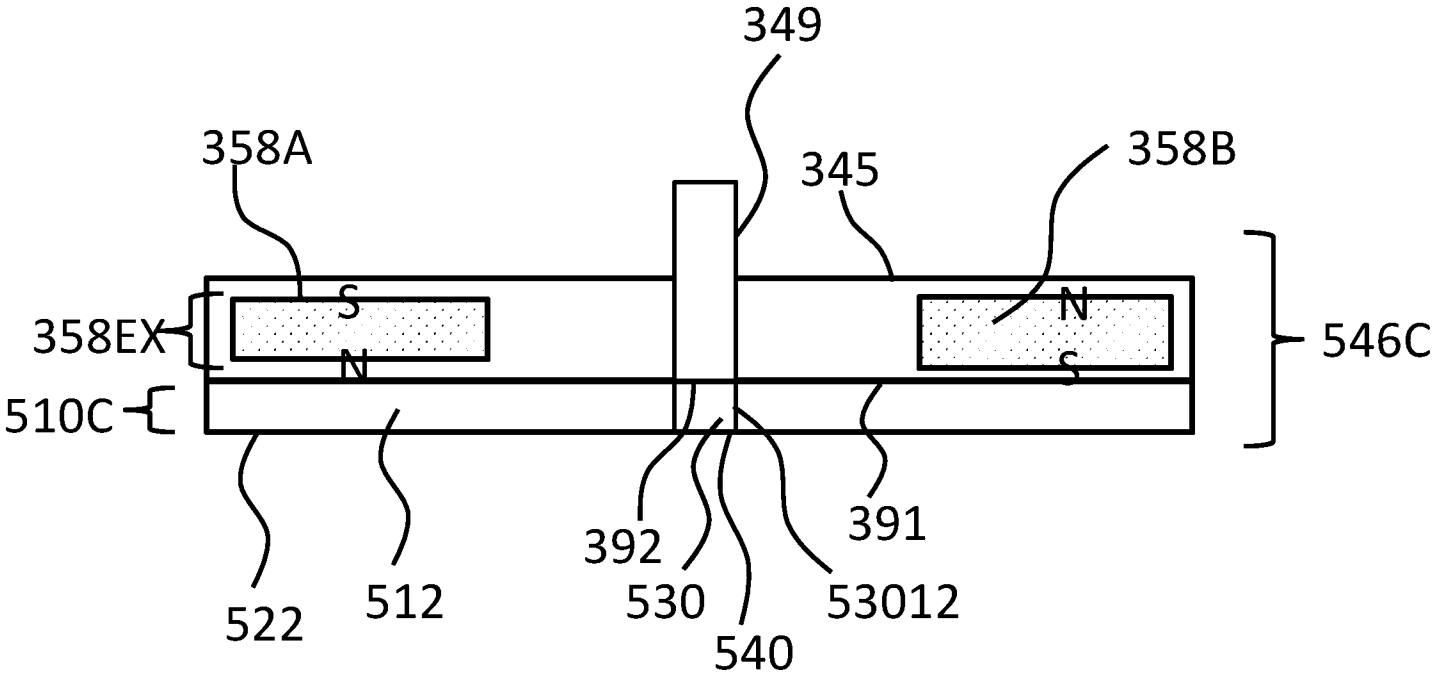

Conversely, there are exemplary embodiments of skin interface assemblies that utilize pads that have portions that have different material properties. By way of example only and not by way of limitation, FIG. 5A in an exemplary skin interface assembly 546A that includes a skin interface apparatus 510A that can be in the form of a pad that does not have uniform properties. In this exemplary embodiment, the skin interface apparatus 510A includes a portion 512 and a portion 530 which are made of different materials. In this exemplary embodiment, the respective skin interface surface is 522 and 530 are also made of different materials/have different material properties. The skin interface apparatus 510A of FIG. 5A is depicted as being used with the housing 347 of the embodiment of FIG. 3A. However, in some embodiments, the skin interface apparatus 510B is utilized with housing 345 of the embodiment of FIG. 3B, as seen in FIG. 5B, which depicts an exemplary skin interface assembly 546B. In this exemplary embodiment, the portion 530 is "aligned" with the structural component 349, as can be seen. In an exemplary embodiment, the structural component and the portion 350 are concentric with one another. While the embodiment depicted in FIG. 5B presents the portion 350 is extending past the outer boundaries of the structural component 349 (relative to the horizontal direction), in an alternate embodiment, the boundaries are aligned with one another (i.e., looking along the longitudinal axis). This is seen in FIG. 5C, which depicts an exemplary skin interface assembly 546C that includes a skin interface apparatus 510C in the form of a pad assembly. That said, in an alternate embodiment, the boundaries of the portion 350 can be located within the boundaries of the structural component 349 (when looking along the axis 390), in whole or in part.

Thus, in the embodiments of FIGS. 5A and 5B (and others), the pad assembly 510A is a pad having non-uniform properties (e.g., material properties) and/or non-uniform features over its entire length and width. There are non-material property discontinuities of the pad assembly 510A in a plane, such as plane 590, extending normal to the longitudinal axis 390 (although it is possible that there are no non-material property discontinuities on such on a plane parallel thereto—this feature is limited to only one plane). Indeed, in some embodiments, there are non-material property discontinuities on all planes that are parallel to plane 590.

An example of the non-material property discontinuity is the boundary between pad 530 and 512. Further, in the embodiments of FIGS. 5A and 5B, there are non-material property discontinuities in at least one plane extending parallel to the longitudinal axis 390 and lying thereon (as will be discussed below). Indeed, in some embodiments, there are non-material property discontinuities in all planes extending parallel to the longitudinal axis 390 and lying thereon. That said, in some embodiments of FIGS. 5A and 5B, the properties at the borders of the pad assembly 510 might also meet the aforementioned features (e.g., the pad could be contained in a skin or the like, a protective surface can be located on the bottom so as to improve the longevity of the pad, etc.). Thus, in some embodiments, the aforementioned features are with respect to locations inboard of the boundaries of the pad assembly 510A. By way of example, the aforementioned features are features present within an area that is bordered within at least 5 or 10 or 20 percent of a respective diameter from the outer border of the pad assembly 510A (e.g., for a given diameter, border points of the aforementioned locations lying on the diameter will be 2.5% or 5% or 10% of the total diameter from the respective outer border).

Figure 5D:
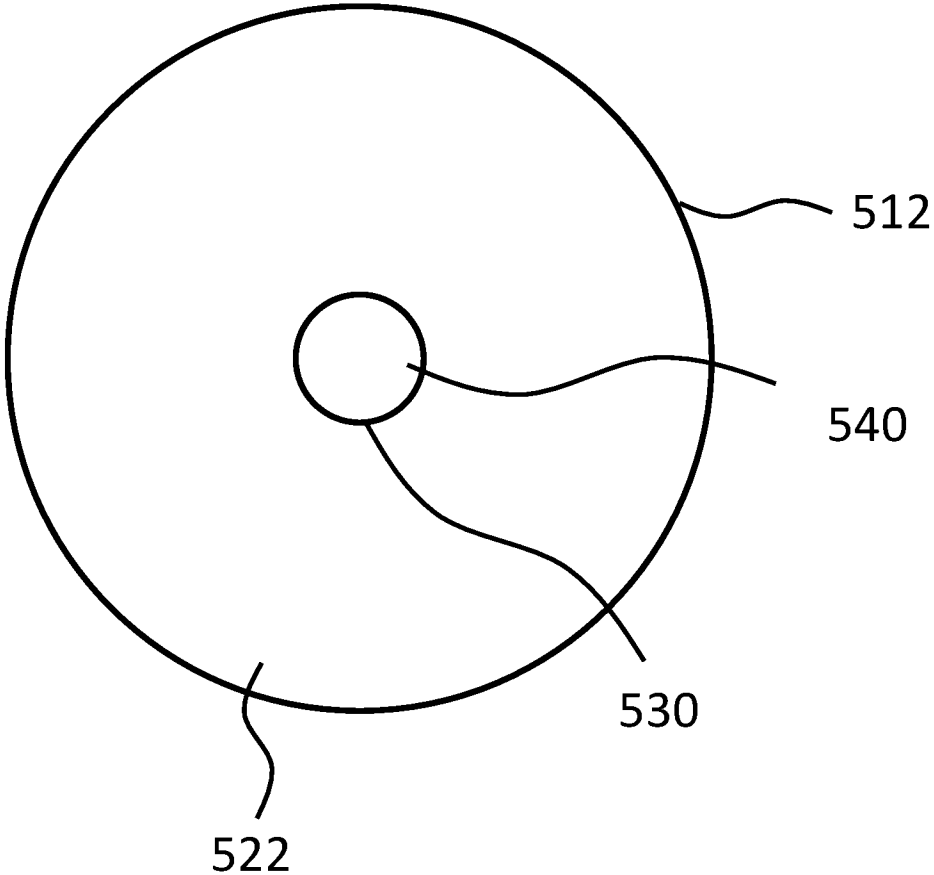
FIGS. 5D and 5E are bottom views of some exemplary skin interface apparatuses according to some exemplary embodiments.

FIG. 5D depicts a bottom view of the embodiment of FIG. 5B. In the exemplary embodiments depicted in FIG. 5B in view of FIG. 5D, it can be seen that the portion 522 abuts the portion 530 at the interface between the two portions extending about the longitudinal axis 390. In this exemplary embodiment, the portion 522 is connected to portion 530 via an adhesive material between the two components. In an alternative embodiment, the 530 is interference fit within portion 522.

In view of the above, in an exemplary embodiment, there is a skin interface apparatus, such as skin interface apparatus 510A, configured as an interface of a prosthesis with skin of a recipient. The skin interface apparatus includes a first portion 512 configured for direct contact with skin of the recipient, and a second portion 530 configured for direct contact with skin of the recipient. In an exemplary embodiment, the first portion and the second portion have different material properties.

In at least some exemplary embodiments, the first portion 512 has a material property that renders first portion 512 softer than the second portion 530. For example, the first portion 512 can be made of a polyurethane foam, and the second portion 530 can be made of a hard polymer. Additional details of the materials from which these portions can be made are discussed below. In some embodiments, the second portion 530 has a material property that is more conductive to vibrations than the first portion 512. By way of example only and not by way of limitation, for a given input from the actuator into a given volume of the second portion 530, the second portion conducts at least 1.5, 2, 2.5, 3, 3.5, 4, 4.5, 5, 5.5, 6, 6.5, 7, 7.5, 8, 8.5, 9, 9.5 or 10 or more times the amount of energy from one side to the other side than that which is the case for the same given input from the actuator into a same volume of the first portion, all other things being equal. In an exemplary embodiment, the given input is at 200 Hz, 300 Hz, 400 Hz, 500 Hz, 600 Hz, 700 Hz, 800 Hz, 900 Hz, 1000 Hz, 1250 Hz, 1500 Hz, 1750 Hz, 2000 Hz, 3000 Hz, 4000 Hz, 5000 Hz, 6000 Hz and/or 7000 Hz or any value or range of values therebetween in 1 Hz increments (e.g., 257 Hz, 1242 Hz, 456 Hz to 5389 Hz, etc.).

In an exemplary embodiment, the first portion 512 forms a first skin interface apparatus, and the second portion 530 forms a second skin interface apparatus. In this exemplary embodiment, the first skin interface apparatus is configured to dampen vibrations more than the second skin interface apparatus. In an exemplary embodiment, the first skin interface apparatus is configured to dampen vibrations substantially more than the second skin interface apparatus. In an exemplary embodiment, this dampening corresponds to the dampening of any given frequency detailed herein where, for a given input, such that the dampening effect of the first skin interface apparatus is 10% more, 20%, 30%, 40%, 50%, 75%, 100%, 150%, 200%, 250%, 300%, 350%, 400%, 450%, 500%, 600%, 700%, 800%, 900%, 1,000%, 1,250%, 1,500%, 1,750% or 2,000% more than the dampening effect of the second skin interface apparatus for that same input at that same frequency, all other things being equal.

In an exemplary embodiment, the aforementioned dampening characteristics can have utilitarian value with respect to reducing and/or eliminating feedback to the microphone 326 located on the removable component of the bone conduction device. Some additional features of the feedback production and/or elimination are described below.

In this regard, in an exemplary embodiment, the first portion 512 is configured to transfer vibrations therethrough at a first transmissibility value, and the second portion 530 is configured to transfer vibrations therethrough at a second transmissibility value substantially higher than the first transmissibility value. In an exemplary embodiment, the second transmissibility value is a value greater than 1. In an exemplary embodiment, the second transmissibility value is a value equal to about 1 (including 1).

In an exemplary embodiment, the second portion (e.g., 530) has a transmissibility value about 5, 6, 7, 8, 9, 10, 11, 12, 13, 14, 15, 16, 17, 18, 19, 20, 40, 60, 80, 100, 125, 150, 200, 250, 300, 400 or 500 times or more higher than a transmissibility value of the first portion (e.g., 512).

In an exemplary embodiment, the aforementioned transmissibility features correspond to any of the frequencies of the given inputs detailed herein.

In an exemplary embodiment, the first portion 512 is elastically different than the second portion 530. By way of example only and not by way of limitation, the first portion 512 can be at least 2, 3, 4, 5, 6, 7, 8, 9 or 10 or more times more elastic than the second portion 530. For example, the modulus of elasticity of the material of the first portion 512 can be 5 times that of the second portion (and thus 5 times more elastic than that of the second portion). Still further by example, the shear modulus of the material of the first portion 512 can be 3 times that of the second portion (and thus 3 times more elastic than that of the second portion).

Still further by example, the modulus of elasticity of the material of the first portion 512 can be 2 times that of the second portion (and thus 2 times more elastic than that of the second portion). In this regard, the aforementioned elasticity variables can be based in any of the aforementioned measurement regimes, or in any other recognized measurement means, such as Axial Modulus, Lame's first parameter, and/or P-wave modulus.

Corollary to the above is that, as can be seen in view of the figures, the exemplary skin interface apparatuses detailed herein and/or variations thereof can be used as part of a removable component of a passive transcutaneous bone conduction device.

Thus, in an exemplary embodiment, there is a removable component of a passive transcutaneous bone conduction device, such as component 340A or 340B of FIGS. 3A and 3B, etc., that includes the actuator and a skin interface apparatus according to any of the embodiments detailed herein.

The skin interface apparatuses discussed above and below can have utilitarian value with respect to a bone conduction device that has a removable component that is functionally at least bifurcated with respect to the support function and the vibration input function. That is, while some embodiments of the removable component of the bone conduction device, such as the embodiment of FIG. 3A, utilize a skin interface assembly that uses the same surface to both support the removable component against the skin of the recipient and convey vibrations thereto, other embodiments of the removable component of the bone conduction device, such as the embodiment of FIG. 3B, utilize a skin interface assembly that uses separate surfaces to respectively support the removable component against the skin of the recipient and convey vibrations thereto. Thus, in an exemplary embodiment, there is a skin interface assembly for an external component of a bone conduction device, such as the skin interface assembly 546B and 546C, comprising a support assembly and a drive assembly. With respect to skin interface assembly 546B, the support assembly includes the housing 345 and the drive assembly includes the structural component 349, which extends completely through the housing 345, and is configured to move relative to the housing 345. In this exemplary embodiment, the support assembly is configured to react against at least substantially all (including all) of a retention force (which includes an attraction force established by the ferromagnetic materials and a compression force established by the soft-band concept, etc.) between the external component 340B and skin of a recipient of the bone conduction device. In this regard, in an exemplary embodiment, this is the functional equivalent, in terms of force distribution, of the structural component 349 and the pad portion 530 not being present. That is, no part of the structural component 349 or the pad portion 530 supports or reacts against the force. That said, in some alternative embodiments, some of the structural component 349 and/or the pad portion 530 reacts against some of the force, but the support assembly still reacts against substantially all of the force. Still further, in an exemplary embodiment, the drive assembly is configured to vibrate in response to sound captured by the external component of the bone conduction device. In this regard, in an exemplary embodiment, the actuator is part of the driving assembly, and the vibrations the actuator are transferred to the structural component 349, and then transferred to pad 530 to skin of the recipient (or directly from the structural components of the skin of the recipient in the case where there is no pad at the end of the structural component, and the structural component directly contacts the skin of the recipient, as will be described below with respect to another embodiment).

In this exemplary embodiment, the support assembly includes a first removable skin interface pad 512 and the driving assembly includes a second removable skin interface pad 530. The pads and/or properties thereof can correspond to any of the pads detailed herein and/or variations thereof.

As just noted, the first removable skin interface pad 512 and the second removable skin interface pad 530 are removable, respectively, from the support assembly and the drive assembly. In an exemplary embodiment, the respective pads can be individually removed (i.e., one pad can be removed without removing the other) and/or can be removed as an assembly (i.e., removing one pad can remove the other pad). Thus, in an exemplary embodiment, with respect to the former, the pads are free components relative to one another, where there is only a bond between the respective pads and the respective surfaces to which they are connected of the housing of the skin interface assembly and/or the structural component (e.g., the bond is located at surface 391 and 392, and nowhere else). Conversely, with respect to the latter, in an exemplary embodiment, the pads are bonded or otherwise connected to one another so as to form a unitary assembly. In an exemplary embodiment, the bond can be present between the outer side wall of pad 530 and the inner side wall of pad 512, represented by reference numeral 53012 in FIG. 5C.

In at least some embodiments, the aforementioned bonds are achieved by an adhesive. In at least some embodiments, the aforementioned bonds can be achieved by a melt or a welding or the like between the two pads. Still further, in an exemplary embodiment, the two pads can be attached to each other via a stitching or the like. Any arrangement that can enable the pads to be attached to one another to enable the teachings detailed herein can be utilized in at least some exemplary embodiments.

Figure 5E:
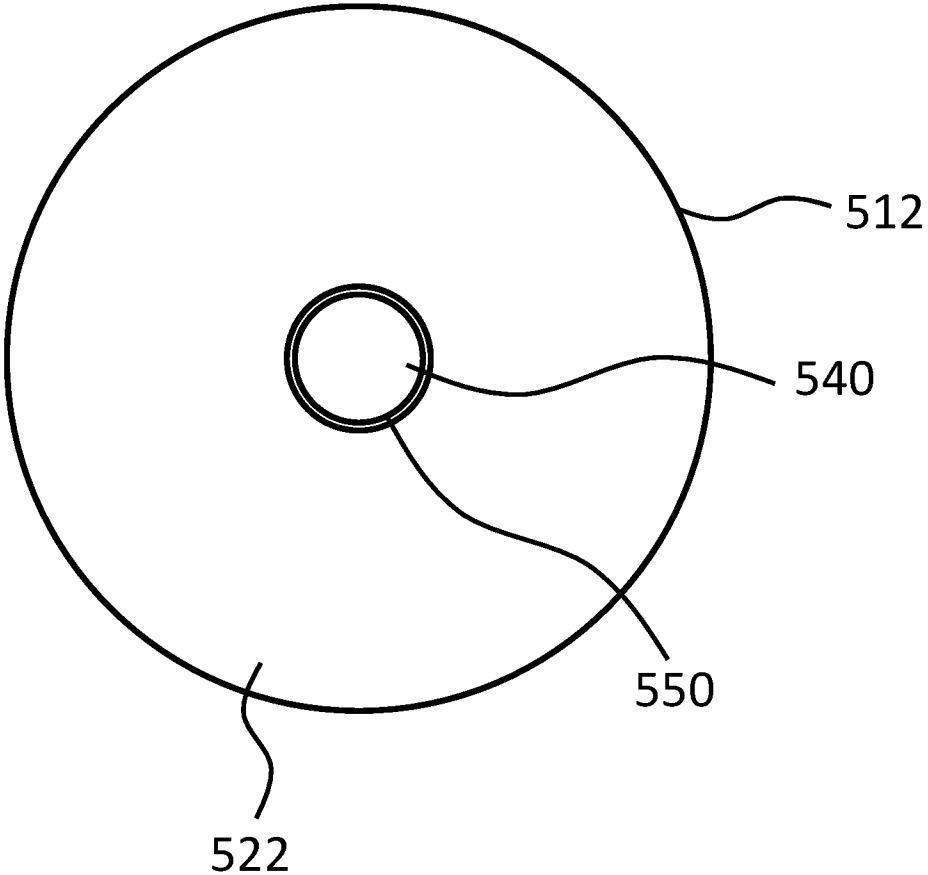

Thus, in an exemplary embodiment, the first removable skin interface pad 512 is directly connected to the second removable skin interface pad 530 (e.g., at the boundary 53012). That said, in an alternate embodiment, the first removable skin interface pad 512 is only indirectly connected to the second removable skin interface pad 530. By way of example, in at least some exemplary embodiments, a barrier is located between the two pads that separates one pad from the other, as can be seen in FIG. 5E, as represented by barrier 550. In an exemplary embodiment, the barrier 550 can be a tube that extends from one side of the pads to the other side of the pads that prevents the two pads from contacting each other. The barrier 550 can be flanged at one or both ends, so as to overlap one or both of the pads. The barrier 550 can enable the attachment of one pad to the other (e.g., the outer and inner surfaces thereof can be barbed so as to grip into the respective pads) or to enable the attachment of the barrier to one pad but not the other pad (e.g., one of the outer inner surfaces of the barrier can be barbed, while the other is smooth, the flanges can extend outward and not in word or vice versa, etc.). The barrier 550 can enable the removability of one pad from the other. By way of example, at least one of the outer surfaces of the inner surfaces can be smooth and coated with a material that prevents the respective pad from bonding or otherwise adhering to the barrier 550.

In an exemplary embodiment, the barrier 550 is configured to substantially vibrationally isolate (including vibrationally isolate) pad 512 from pad 530. In an exemplary embodiment, the skin interface pad 512 is effectively vibrationally isolated from the skin interface pad 530 (absent another vibrational path between the pad 530 and the pad 512 other than the connector 950) as a result of the barrier 550. That is, vibrations imparted to the pad 530 via the structural component 349 will not be transferred to the pad 512, at least not via the barrier 550, or at least only a negligible amount of vibrations transferred to the pad 530 will be transferred to the pad 512 through the barrier 550. In an exemplary embodiment, for one or more or all of the given frequencies detailed herein, with respect to the input vibration into the pad connected to the structural component that is in vibrational communication with the actuator (e.g., pad 530 in the embodiment of FIG. 5E), the transmissibility value of the path from the pad 530, through the barrier 550, to the pad 512, all other things being equal, is less than 0.8, 0.7, 0.5, 0.4, 0.3, 0.2, 0.1, 0.09, 0.075, 0.05, 0.025, 0.01, 0.009, 0.0075, 0.005, 0.0025 or 0.001.

Figure 5F:
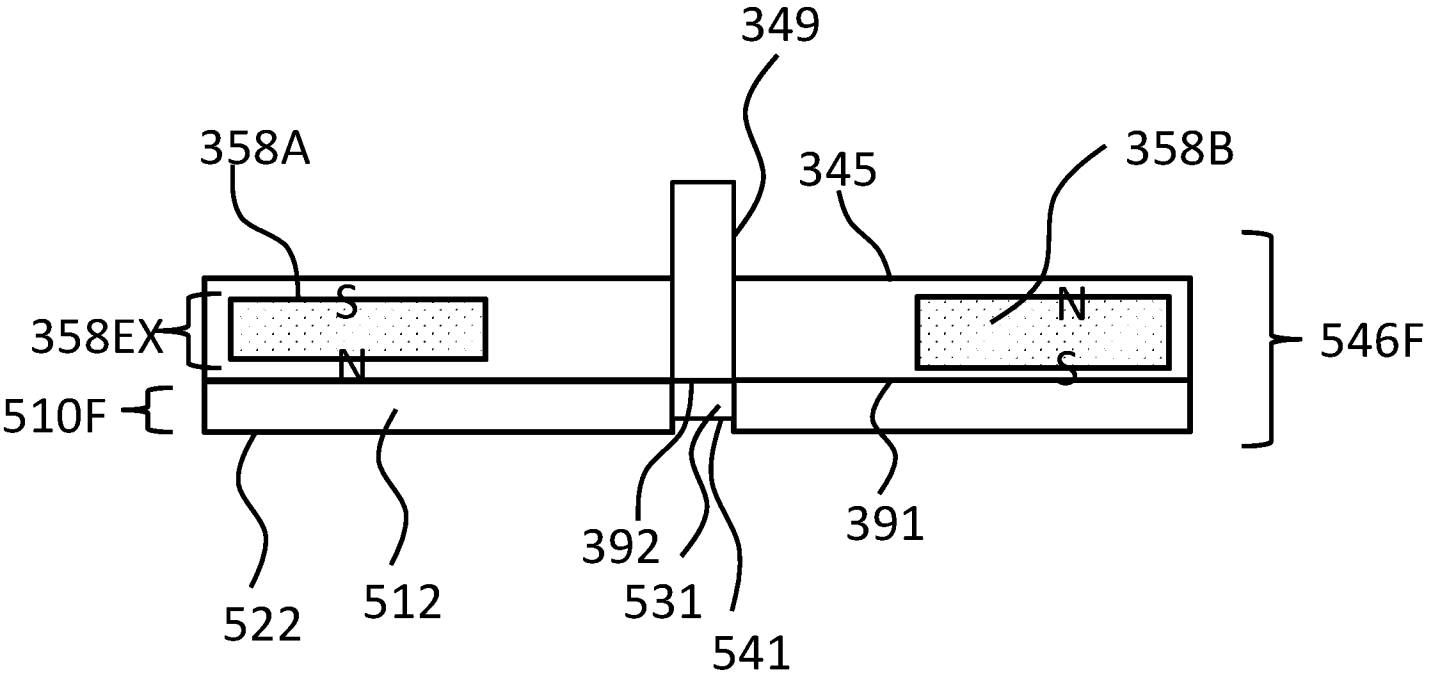
FIG. 5F is a schematic diagram illustrating another exemplary skin interface assembly according to another exemplary embodiment.

Still with reference to FIG. 5C and the embodiment without the barrier 550, the removable skin interface pad 512 is in direct contact with the second removable skin interface pad 530. In some embodiments, the first removable skin interface pad 512 has different material properties than the second removable skin interface pad 530. By way of example only and not by way of limitation, in an exemplary embodiment, the material properties of the pad 512 are much less conducive to vibration transmission then the properties of the pad 530. Still further by way of example only and not by way of limitation, in an exemplary embodiment, the skin interface pad 512 is more compressible than that of the pad 530. Corollary to this, is in at least some exemplary embodiments, the thicknesses of the pads are set so as to compensate for the fact that the pad of the support apparatus will compress from a first thickness to a second thickness by an amount greater than the pad of the driver. In this regard, FIG. 5F depicts an alternate exemplary embodiment of a skin interface apparatus 510F that is part of an exemplary skin interface assembly 546F, where instead of pad 530, 531 is present that has a thickness, in a noncompressed state that is less than that of the pad 530. As can be seen, pad 531 is positioned such that the bottom surface 541 thereof is located above the bottom surface 522 of the pad 512. Accordingly, in an exemplary embodiment, when the removable component of the bone conduction device of which the skin interface assembly 546F is a part is retained against the skin of the recipient via the magnetic coupling apparatus, etc., thus compressing the pad 512, the fact that the pad 531 is less compressible than the pad 512 will not cause a significant discontinuity between the skin of the recipient and the bottom surface 522 of the pad 512 in the areas about the interface between the pad 531 and the pad 512.

Other different material properties of the pads will be discussed in greater detail below. That said, it is briefly noted that in some species of the genus, different material properties include configurations of the skin interface apparatus where the first pad is made of a different material and/or is of a second configuration than the second pad. By way of example only and not by way limitation, in an exemplary embodiment, the first pad 512 can be a gel pack or the like, and the second pad 630 can be a hardened polymer. By way of example only and not by way of limitation, the first pad 512 can be a dilatant or rheopectic material or any other material that can enable the teachings detained herein contained in a cover, a container, a bladder, a film, a bubble, a skin, or other structure.

In an exemplary embodiment, the first pad (e.g., pad 512) is a pad that is skin friendly, soft, and configured to distribute the load of the removable component of the bone conduction device effectively (e.g., evenly). In an exemplary embodiment, the second pad (e.g., pad 530) is a pad configured to enable sound transmission from the structural component 349 to the skin of the recipient. In some embodiments, the second pad is skin friendly, however, in some embodiments, the first pad will be more skin friendly than the second pad.

Again, additional details of the constituent parts and material properties of the pads will be described below.

The length of the barrier 550 can extend the full thickness of the pads, or can stop short of extending the full thickness of the pads. In this regard, in an exemplary embodiment, the barrier 550 can stop just above the bottom surface 540 and or 522 of the respective pads so as to avoid contact of the barrier with the skin, with the pads in a non-compressed state and/or with the pads in a compressed state. That said, in some embodiments, the barrier 550 can be configured in a range such that the barrier does contact the skin in a compressed state.

Figure 6:
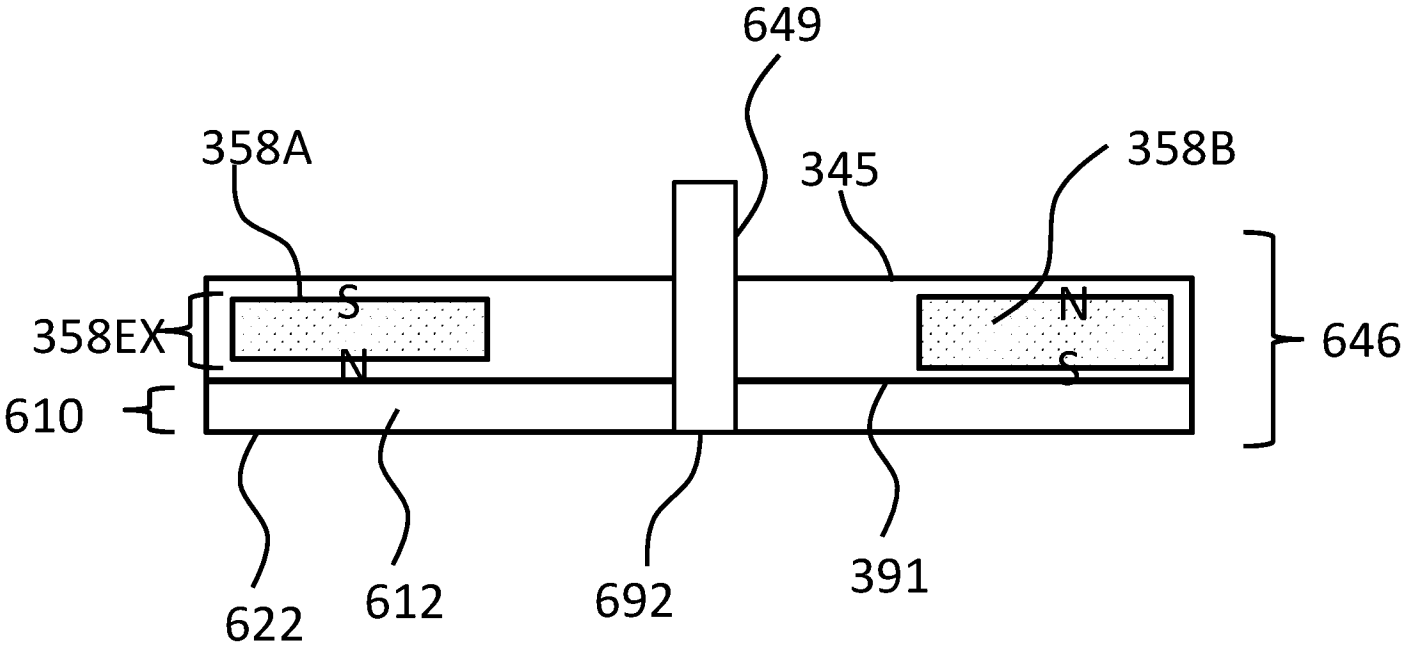
FIG. 6 is a schematic diagram illustrating another exemplary skin interface assembly according to another exemplary embodiment.

FIG. 6 depicts an alternate exemplary embodiment of a skin interface assembly 646 which can correspond to the skin interface assembly used with the embodiment of FIG. 3B. In FIG. 6, the skin interface apparatus 610 is a pad 612 that has a through hole therethrough through which the structural component 649, which can correspond to structural component 349 of FIG. 3B, extends such that the distal surface 692 of the structural component 649 can directly contacts skin of the recipient. In this regard, there is no separate skin interface apparatus or portion thereof located between surface 692 and the skin of the recipient. This as contrasted to the placement of the pad 612 between the surface 391 of the housing 345 and the skin of the recipient. Thus, the skin interface surface of the skin interface assembly 646 of FIG. 6 encompasses the bottom surface 622 of the pad 621 and the bottom surface 692 of the structural component 649.

It is noted that the concepts associated with FIG. 5F detailed above (the surface 541 of the pad 531 being recessed relative to the bottom surface 522 of the pad 512) can also be applicable to this embodiment where the structural component 649 interfaces directly with the skin of the recipient. That is, the location of the structural component 649, or more particularly, the location of the surface 692 of the structural component 649, can be positioned such that in a relaxed state of the pad 612, the surface 692 is recessed relative the surface 612, but when the skin interface assembly 646 is applied against the skin of the recipient, the pad 612 is sufficiently compressed so that the surface 692 is in direct contact with the skin of the recipient (through all or substantially all of the ranges of motion thereof when the bone conduction device of which the skin interface assembly 646 apart is utilized to implement bone conduction vibration).

Thus, in an exemplary embodiment, broadly speaking, there is a removable component of a bone conduction device, such as removable component 340A or 340B, comprising a first skin interface apparatus (e.g., pad 512, 612, etc.) configured to serve as an interface between a support apparatus of the device and skin of a recipient, and a second skin interface apparatus (e.g., pad 530, structural component 649, etc.) configured to serve as an interface between a vibratory apparatus of the device (e.g., actuator 342B) and skin of the recipient. In this exemplary embodiment, the skin interface apparatuses are different. In an exemplary embodiment, the first skin interface apparatus is an elastic pad and the second skin interface apparatus is a metallic component. In an exemplary embodiment, the first skin interface apparatus is soft and the second skin interface apparatus is, relative to the first skin interface apparatus, hard. In an exemplary embodiment, the first skin interface apparatus is flexible and the second skin interface apparatus, relative to the first skin interface apparatus, is relatively inflexible. In an exemplary embodiment, the first skin interface apparatus is compressible and the second skin interface apparatus is, relative to the first skin interface apparatus, incompressible. In an exemplary embodiment, the first skin interface apparatus is, on a per unit area basis, relatively conformable to an opposite surface to which the first skin interface apparatus is in contact, for a given retention force of the external component of the bone conduction device, and the second skin interface apparatus is, on a per unit area basis, relatively in conformable to an opposite surface to which the second skin interface apparatus is in contact.

Figure 7A:
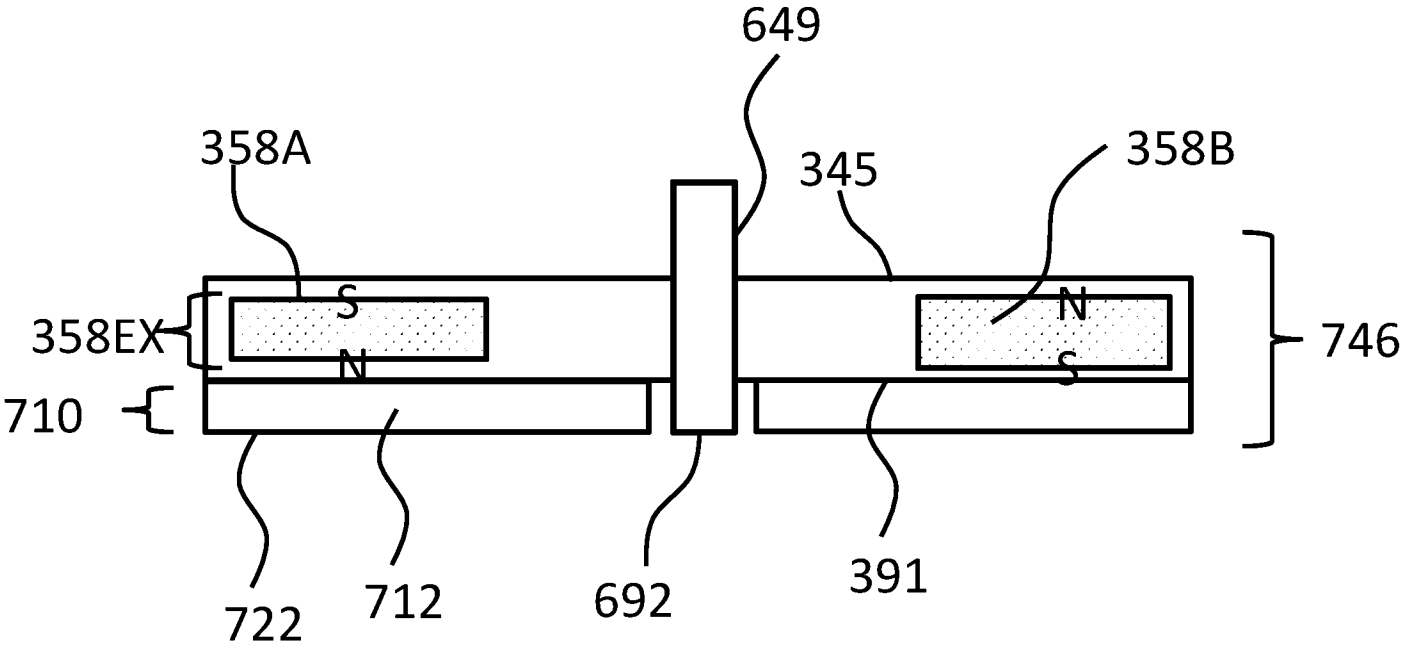
FIGS. 7A-B are schematic diagrams illustrating other exemplary skin interface assemblies according to some other exemplary embodiments.

The embodiment depicted in FIG. 6 depicts the pad 612 in direct contact with the structural component 649 along the sidewalls thereof. That said, in an alternate embodiment, the pad 612 does not directly contact the structural component 649. In this regard, FIG. 7A depicts an exemplary embodiment of a skin interface assembly 746 that includes a skin interface apparatus 710 that includes only one pad 712, which pad is separated by a distance from the structural component 649. Thus, the skin interface surface of the skin interface assembly 746 of FIG. 7A encompasses the bottom surface 722 of the pad 621 and the bottom surface 692 of the structural component 649.

Figure 7B:
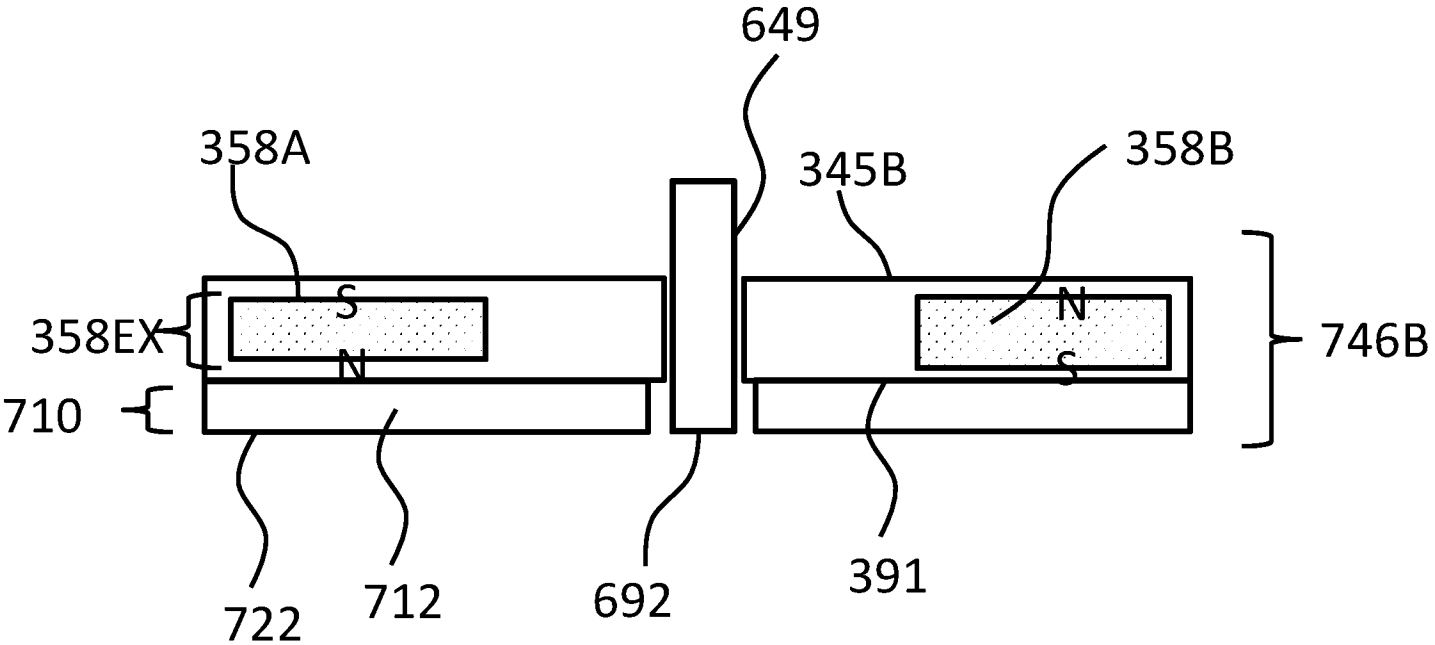

In this regard, the pad 712 is only indirectly connected to the structural component 649. This is accomplished via a path that extends from the pad 712, through the housing 345, to the structural component 649 (where the structural component 649 directly contacts the housing (e.g., by a slip fit, where the walls of the housing are lubricated or otherwise configured to provide little to no resistance of movement of the structural component 649 relative thereto). That said, in an alternate embodiment, the housing 345 does not directly contact the structural component 649. Instead, the walls of the housing 345 are set away from the structural component 649. This is depicted by way of example in FIG. 7B, where skin interface assembly 746B includes housing 345B having a through hole therethrough to provide clearance for the structural component 649. (It is noted that the "back lines" of the figures have variously been removed for purposes of clarity. With respect to FIG. 7B, there would be lines extending from the housing 345B to the structural component 649, as well as lines extending from pad 712 to the structural component 649, if the "back lines" were depicted, owing to the fact that these components circumnavigate the longitudinal axis of the structural component 649.) With regard to the embodiment of FIG. 7B, the pad 712 would be indirectly connected to the structural component 649 by a path that extends through the housing 345B, through pillars 301, through housing 344B, then to structural component 649, if such was in direct contact with the housing/seals of the housing. If the housing 344B was not in direct contact with the structural component 649, the path would extend, starting at the housing 344B, to the spring 343A, then to actuator 342B, and then to structural component 649.

In view of the above, in an exemplary embodiment, there is a skin interface assembly, including a skin interface apparatus, such as apparatus 846, wherein the first removable skin interface pad 812 is completely separated from the second removable skin interface pad 830, and the second removable skin interface pad 830 is coupled to the first removable skin interface pad 812 only by a path that extends from the second pad 830 to the first removable skin interface pad 812 while passing thorough the driver apparatus (granted, that path can extend through other components, such as the housing, but in this embodiment, at least a portion of the path must extend through at least a portion of the structural component 849 and/or other portion of the drive assembly).

Figure 8:
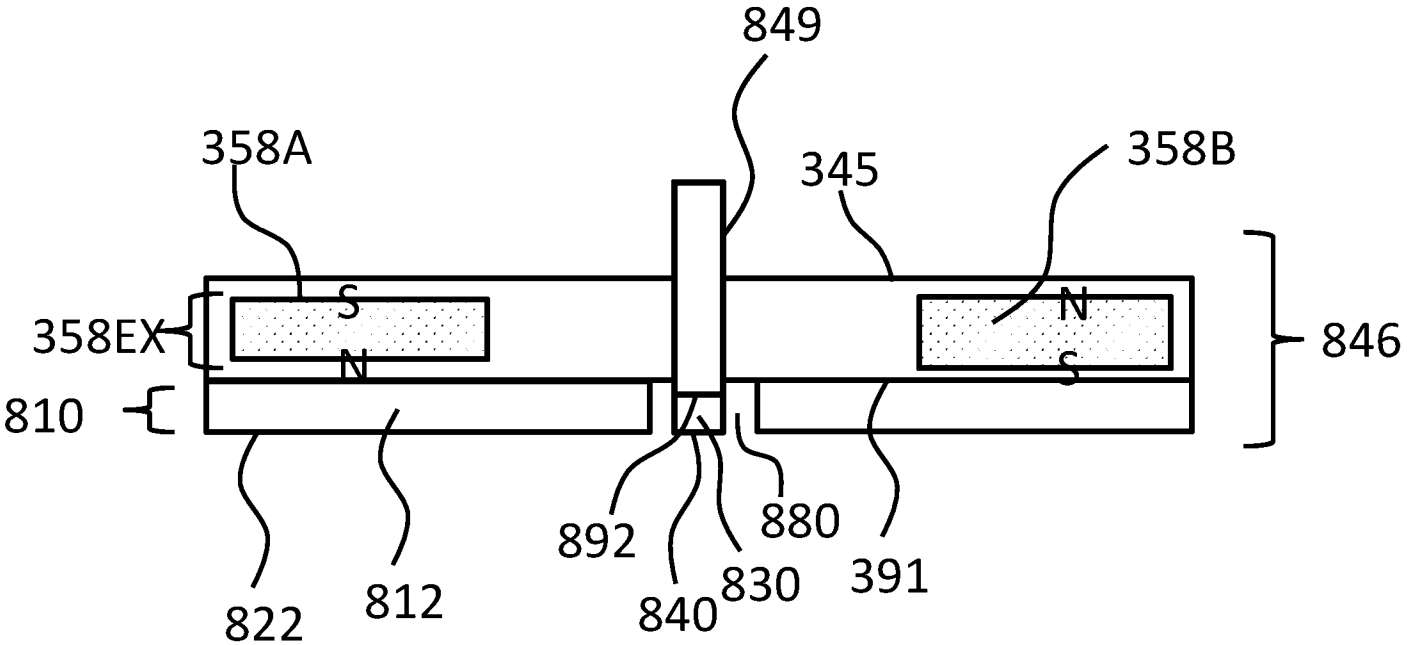

FIG. 8 depicts a variation of the embodiment of FIG. 7A, except that the structural component 849 does not extend as far downward as the structural component 649 of FIG. 7A, and there is a pad 830 located on the distal surface 892 of the structural component 849. In this regard, the skin interface apparatus 810 includes a pad 812 having a skin contact surface 822 which is separated by distance from the pad 830 (which as a skin interface surface 840) and is separated by that same distance from structural component 849 (although in other embodiments the distance can be different, and, in some other embodiments, there is no separation).

FIG. 8 also depicts a feature that differentiates from some of the other embodiments herein in that the thickness of the pad 830 connected (directly connected) to the structural component 849 is thinner than that of pad 530 for example, and the distance that the structural component 849 extends from the bottom of the surface 391 of the housing 345 is greater than that of structural component 549. Note further that in some alternate embodiments, this difference can be reversed in that the structural component 849 does not extend past (below) the bottom surface 391 of the housing 345, in which case the pad 830 can extend into the housing 345. Also, it is noted that the embodiment of FIG. 8 can be implemented where the pad 830 is the same thickness as the pad 812, and the structural component 849 has the same configuration as the structural component 549 in that the bottom surface 892 only slightly extends past the bottom surface 391 of housing 345.

The embodiment of FIG. 8 depicts an embodiment where the first removable skin interface pad 812 is separated by an open space 880 from the second removable skin interface pad 830 that completely surrounds the second removable skin interface pad 830.

Figure 9A:
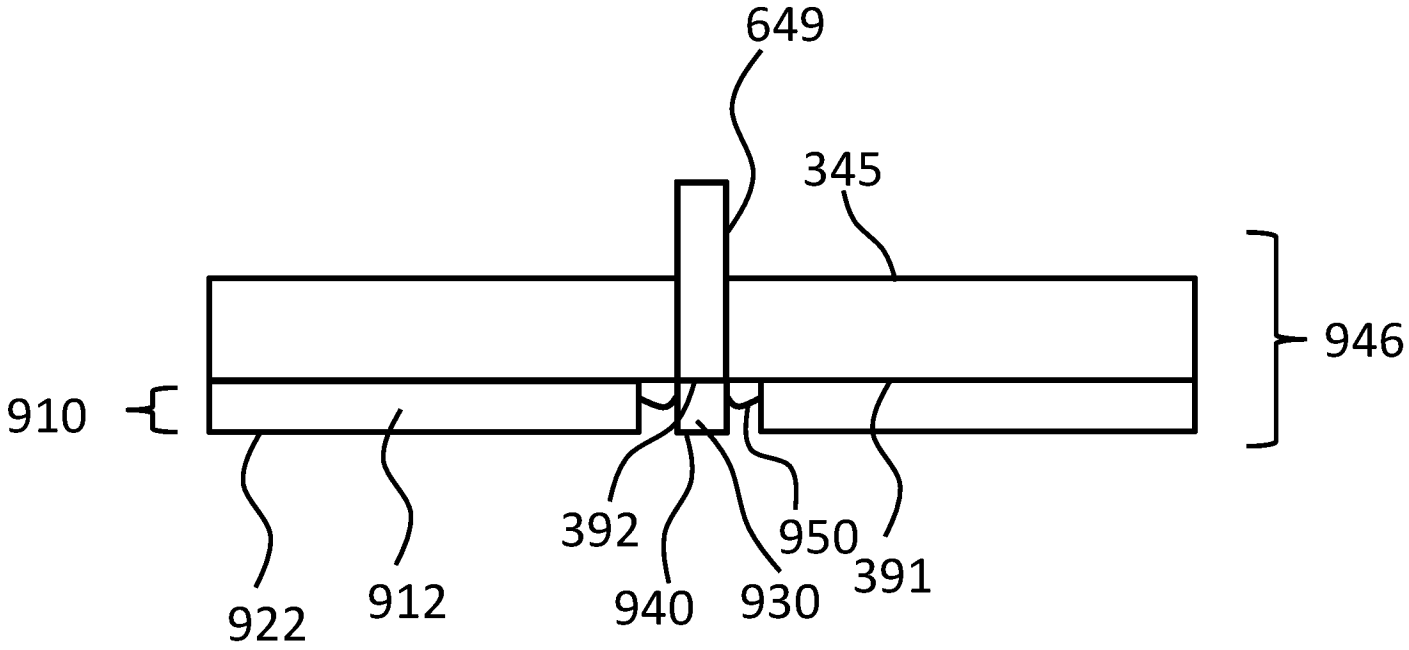

FIG. 9A depicts an alternate embodiment of a skin interface assembly 946 that is usable with the skin interface assembly of the embodiment of FIG. 3B. It is noted that this embodiment depicts a configuration that is usable with a removable component that is held against the head of the recipient via a soft band or a clamping feature. In this regard, as can be seen in FIG. 9A, there are no magnets enclosed within the housing 345. That said, in an alternate embodiment, housing 345 can include the magnets as is the case with the embodiments above. In this regard, FIG. 9 is presented without the magnets simply to demonstrate an exemplary embodiment that does not utilize magnets. It is noted that the embodiments detailed herein that utilize magnets can also be utilized with a soft band retention system and/or a clamping feature.

Still with reference to FIG. 9A, as can be seen, there is a skin interface apparatus 910, that entails a pad 912 that includes a skin interface surface 922, and a pad 930, that includes a skin interface surface 940. In this exemplary embodiment, the pads 912 and 930 are loosely connected via a connector 950. In an exemplary embodiment, connection system 950 entails a diaphragm structure that extends across the space between the pad 912 and the pad 930 so as to connect the pad 912 to the pad 930 across the path that extends through the connection system 950. In an exemplary embodiment, the connector 950 is a web structure made up of a plurality of strands that extend from the pad 912 to the pad 930. In an exemplary embodiment, the connector 950 entails one or more strings that extend from the pad 912 to the pad 930. This can be seen in FIG. 9B, which represents a bottom modified view of the skin interface assembly 946. In this regard, the embodiment of FIG. 9B utilizes a rectangular shaped skin interface apparatus, or more accurately, a skin interface apparatus having a housing that has a footprint that is rectangular in shape, instead of a circular skin interface apparatus. As can be seen, pad 912 is connected to pad 930 by strings 950 (four in total). Alternatively, a film can extend across the top portion or the bottom portion of the pads, as is depicted by way of example in FIG. 9C, where support film 953 loosely connects pad 930 to pad 912.

While the embodiments just described present a connector 950 that is flexible, in alternative embodiments, the connector 950 can be rigid while articulateable relative to the pad 912 and/or the pad 930. In this regard, the connector can be a beam (or plurality of beams) that articulates relative to one or both of the pads 912 and 930. The beam(s) can be extendable and/or retractable and/or the pads 912 and 930 can be configured so as to permit the beam to move relative to the pad 912 and/or 930 so as to account for the fact that the pad 930 will move in the direction of the longitudinal axis when the actuator vibrates.

Accordingly, with respect to the embodiment of FIG. 9, there is a bone conduction device including the first and second removable skin interface pads as detailed herein, wherein the first removable skin interface pad (e.g., pad 912) is loosely coupled to the second removable skin interface pad (e.g., pad 930).

Figure 9B:
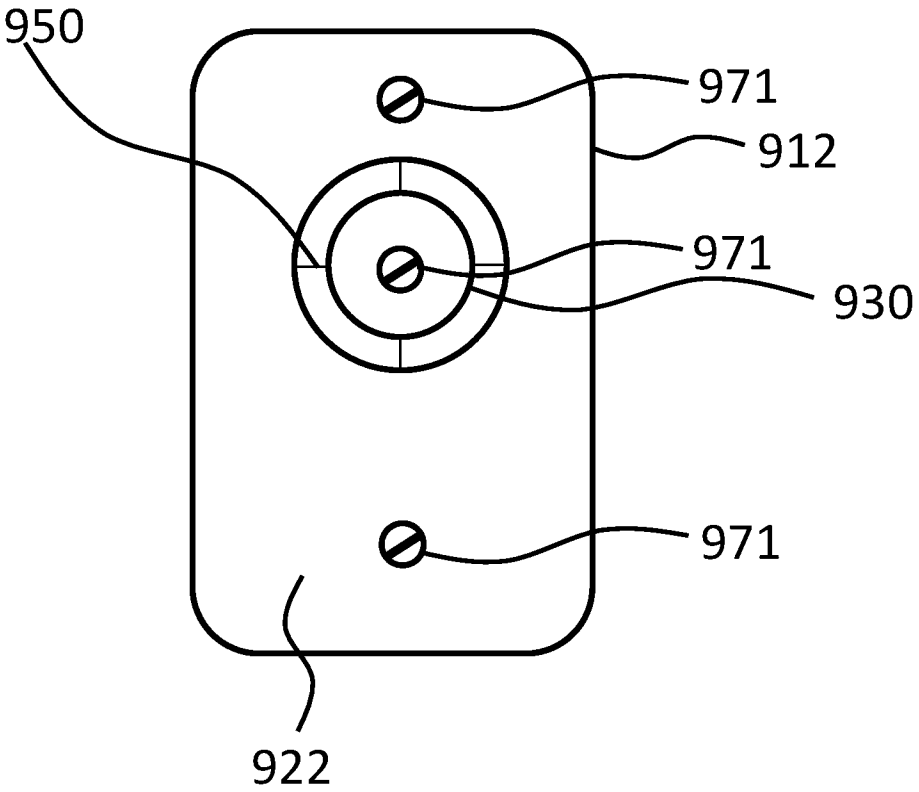
FIGS. 9B and 9C are bottom views of some exemplary skin interface apparatuses according to some exemplary embodiments.

In an exemplary embodiment, the pad 912 is configured to be removable from the rest of the removable component of the bone conduction device 340B in general, and surfaces 391 and 392 in particular. By way of example only and not by way of limitation, an adhesive can be located between the pad 912 and the housing 345 and between the pad 930 and the structural component 649 (or the adhesive is located only between the pad 912 and the housing 345 which relies on (i) a coupling between the pad 912 and the pad 930, or (b) the fact that the pad 912 and the pad 930 are directly connected to one another), to maintain the pad 930 and position relative to the structural component 649 that is strong enough to adhere the interface apparatus 910 to the rest of the skin interface assembly 946 during normal use but is weak enough such that a moderately strong pulling of the interface apparatus 910 away from the skin interface assembly 946 will remove the interface apparatus 910 completely from the rest of the skin interface assembly 946. Alternatively, a mechanical fastening apparatus can be utilized that fastens the pad 912 to the housing 345 and/or the pad 930 to the structural component 649. In this regard, FIG. 9B depicts mechanical fasteners 971 in the form of screws that extend through the respective pads into, respectively, the housing and the structural component of the skin interface assembly 946. By way of example, the screws 971 are recessed (or, more accurately, the pads include countersink holes) such that the screws lie above the bottom surface 922 and 940 of the skin interface assembly 946 so that the screws do not come into contact with the skin of the recipient. In an exemplary embodiment, the recess is such that even with compression that will occur when the removable component of the bone conduction device is retained against skin of the recipient, and the pads compress, the screws do not contact the skin of the recipient.

In an exemplary embodiment, to remove the skin interface apparatus 910, the screws are undone so that the skin interface apparatus 910 can be removed from the housing and structural components to which they are connected.

Figure 9C:
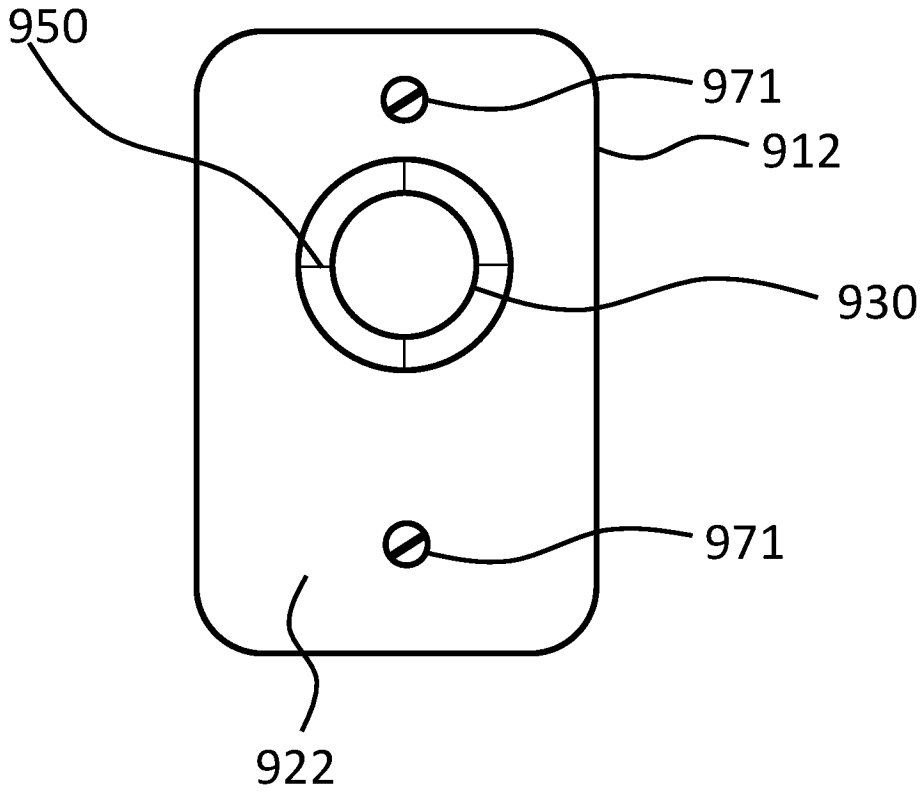
Figure 9D:
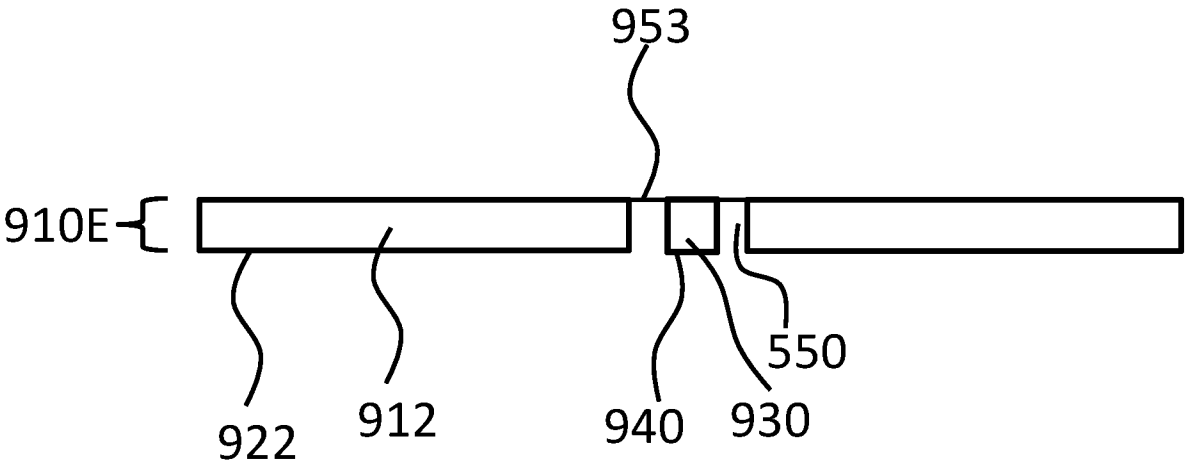
FIG. 9D is an exemplary schematic diagram of an exemplary skin interface assembly.

FIG. 9C depicts an alternate embodiment where pad 930 is only loosely connected to the pad 912, and there is no direct retention between pad 930 and the structural component 946 to which it is in contact. Instead, the connector 950 is the only thing that holds the pad 930 against the structural component 649. In an exemplary embodiment, the connector 950 is configured to hold the pad 930 against the structural component 649 such that there is tension in the connector 950 (or compression in the connector 950, depending on the orientation thereof) at all times so that there is always a force pushing the pad 930 against the bottom surface 392 of the structural component 649. Thus, in respect of the movements of the structural component 649 relative to the stationary component of the housing 345, the pad 930 is always maintained against the surface 392.

It is noted that in at least some exemplary embodiments utilizing the mechanical fasteners, there will be a modicum of rigidity and/or structural stability to the pad 912 and/or the pad 930 so that the relatively limited number of fasteners that are utilized sufficiently hold the pad 912 and/or the pad 930 in place against the rest of the skin interface assembly 949. That is, the pad 912 and/or the pad 930 has sufficient structural rigidity such that the pad will not "hang down" away from the housing 345, with distance away from the fasteners 971. This as contrasted to the embodiments where an adhesive is located over the entire surface 391 and/or 392 and where the pads have a footprint that is the same as or smaller than (within the boundaries of) the respective mating components of the skin interface assembly. That said, in some embodiments, adhesive is utilized with such rigid pads.

It is noted that the mechanical fastener arrangement can be combined with an adhesive arrangement. Any arrangement that can enable the teachings detailed herein and/or variations thereof to be practiced so as to adhere or otherwise hold the interface portion 910 or any other interface portion for that matter against the rest of the skin interface assembly of the removable component of the bone conduction device can be utilized in at least some exemplary embodiments.

It is noted that in an exemplary embodiment, the connector 950 is configured such that the first removable skin interface pad 912 is substantially vibrationally isolated from the second removable skin interface pad 930. In an exemplary embodiment, the skin interface pad 912 is effectively vibrationally isolated from the skin interface pad 930 (absent another vibrational path between the pad 930 and the pad 912 other than the connector 950. That is, vibrations imparted to the pad 930 via the structural component 649 will not be transferred to the pad 912, at least not via the connector 950, or at least only a negligible amount of vibrations transferred to the pad 930 will be transferred to the pad 912 via the connector 950. In an exemplary embodiment, for one or more or all of the given frequencies detailed herein with respect to the input vibration into the pad connected to the structural component that is in vibrational communication with the actuator (e.g., pad 930 in the embodiment of FIG. 9A), the transmissibility value of the connector, all other things being equal, is less than 0.8, 0.7, 0.5, 0.4, 0.3, 0.2, 0.1, 0.09, 0.075, 0.05, 0.025, 0.01, 0.009, 0.0075, 0.005, 0.0025, or 0.001.

Figure 10:
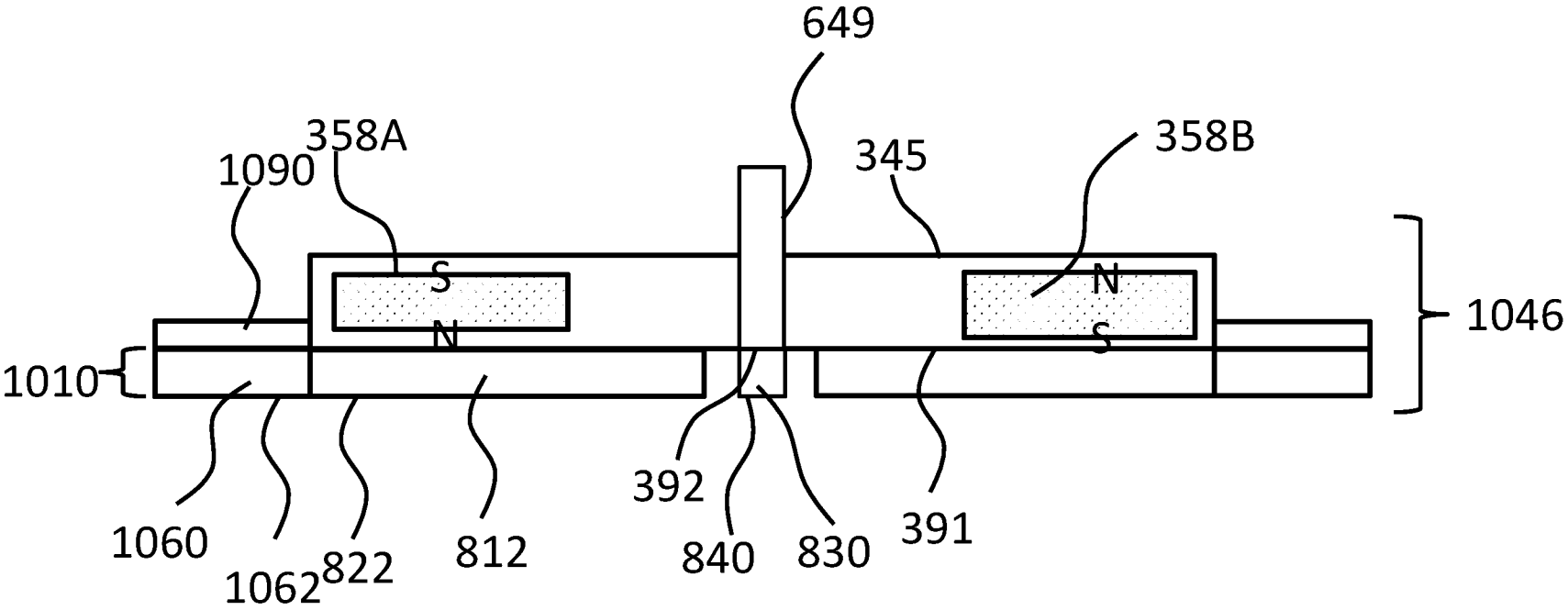
FIGS. 10 and 11 are schematic diagrams illustrating other exemplary skin interface assemblies according to some other exemplary embodiments.

FIG. 10 depicts yet another embodiment of a skin interface assembly usable with the bone conduction devices herein. In particular, FIG. 10 depicts skin interface assembly 1046, which corresponds to skin interface assembly 846 detailed above, with the addition of a third component that manages vibrations that travel through the skin and then back to the bone conduction device. In this regard, a plate 1090 extends about the housing 345. While the embodiment depicted in FIG. 10 depicts the plate 1090 rigidly connected to the housing 345, an alternate embodiment, the plate 1090 is flexibly connected to the housing 345. Still further, in an alternate embodiment, the plate 1090 can be connected to the housing 344B of the bone conduction device. This connection to the housing 344B can be rigid or flexible, depending on the utilitarian features desired. In an exemplary embodiment, a pad 1060 is connected to the bottom surface of plate 1090. In an exemplary embodiment, pad 1060 is a separate component from pad 812. In this regard, the skin interface assembly 1010 that is part of the skin interface assembly 1046 includes pad 1060, pad 812, and pad 830. It is noted that the other pads detailed herein can be used in conjunction with pad 1060. As can be seen, pad 1060 is in direct contact with pad 812. That said, in an alternate embodiment, the pad connected to the plate 1090 is offset from the pad that is directly connected to the housing 345, as is seen by way of example in FIG. 11, where the skin interface assembly 1146 includes a skin interface apparatus 1110 that includes pad 1160, pad 912 and pad 930, where pad 912 is loosely connected to pad 930 in accordance with the embodiment of FIG. 9, and pad 1160 is loosely connected to pad 912 also in accordance with the teachings of the embodiment of FIG. 9 (the loose connections not being shown in FIG. 11).

In the embodiment of FIG. 10, the bottom surface of pad 1060 is configured to directly interface with the surface of the skin of the recipient, or, more accurately, the skin interface assembly 1046 is configured, during normal use, such that the surface 1062 interfaces with the skin of the recipient. Conversely, with respect to the embodiment of FIG. 11, pad 1160 and the general arrangement of skin interface assembly 1146 is such that the surface 1162 of pad 1160 does not come into direct contact with skin of the recipient during normal use.

Figure 11:
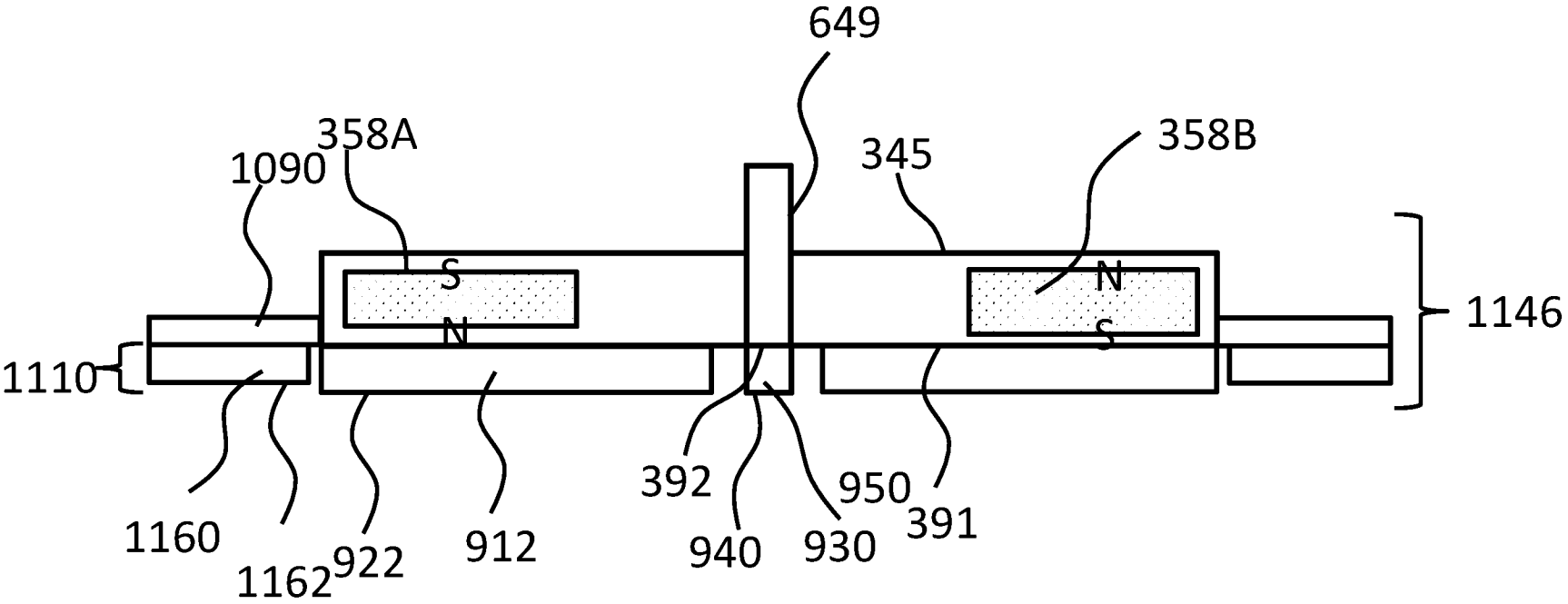

In an exemplary embodiment, the pads 1060 and 1160 of the embodiments of FIGS. 10 and 11 can have utilitarian value with respect to managing transduction oif vibrations that are originated or otherwise generated by the drive apparatus that travel through skin of the recipient and then head back towards the skin interface assembly.

Figure 12:
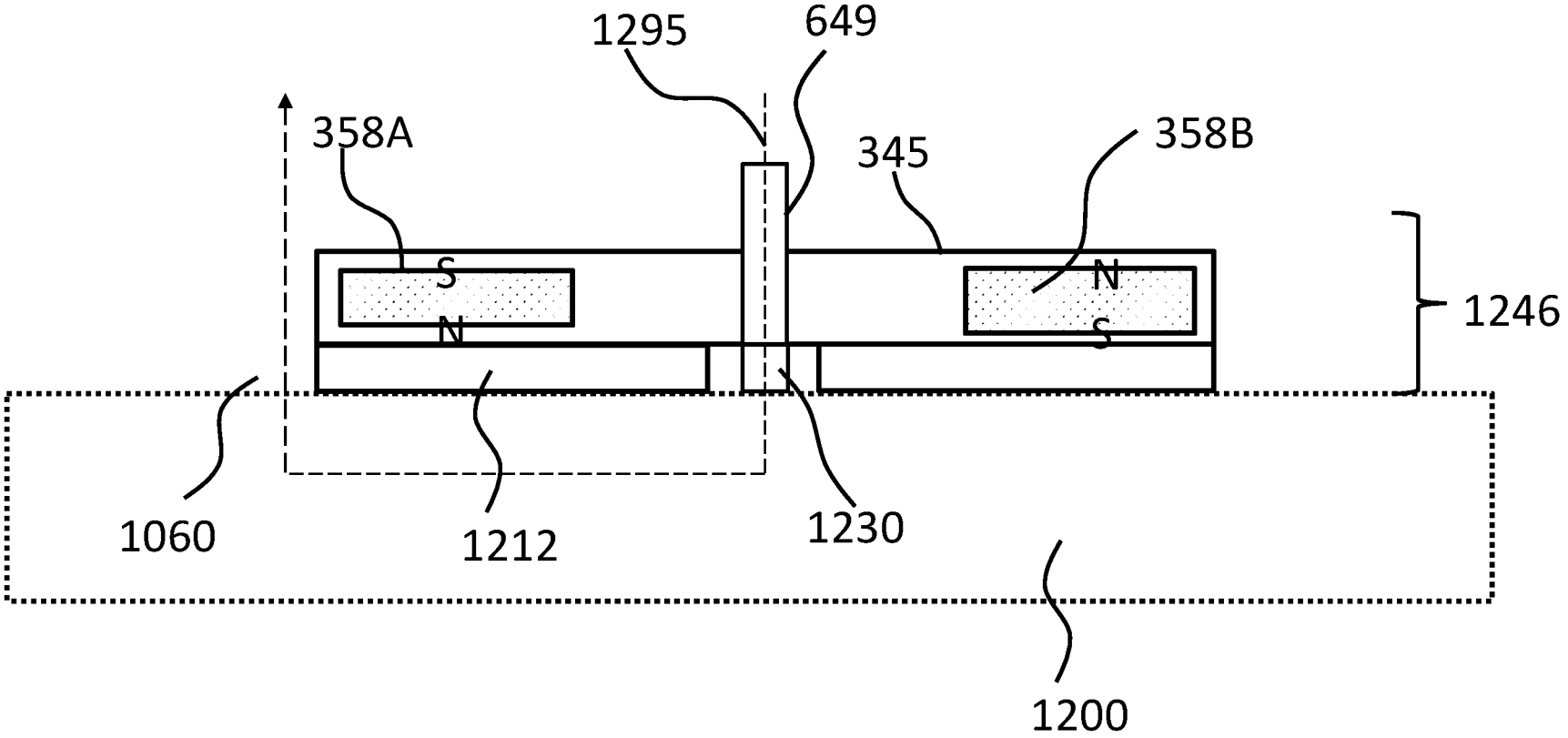
FIGS. 12-13B are schematic diagrams illustrating paths of vibrational energy according to some exemplary embodiments.
Figure 13A:
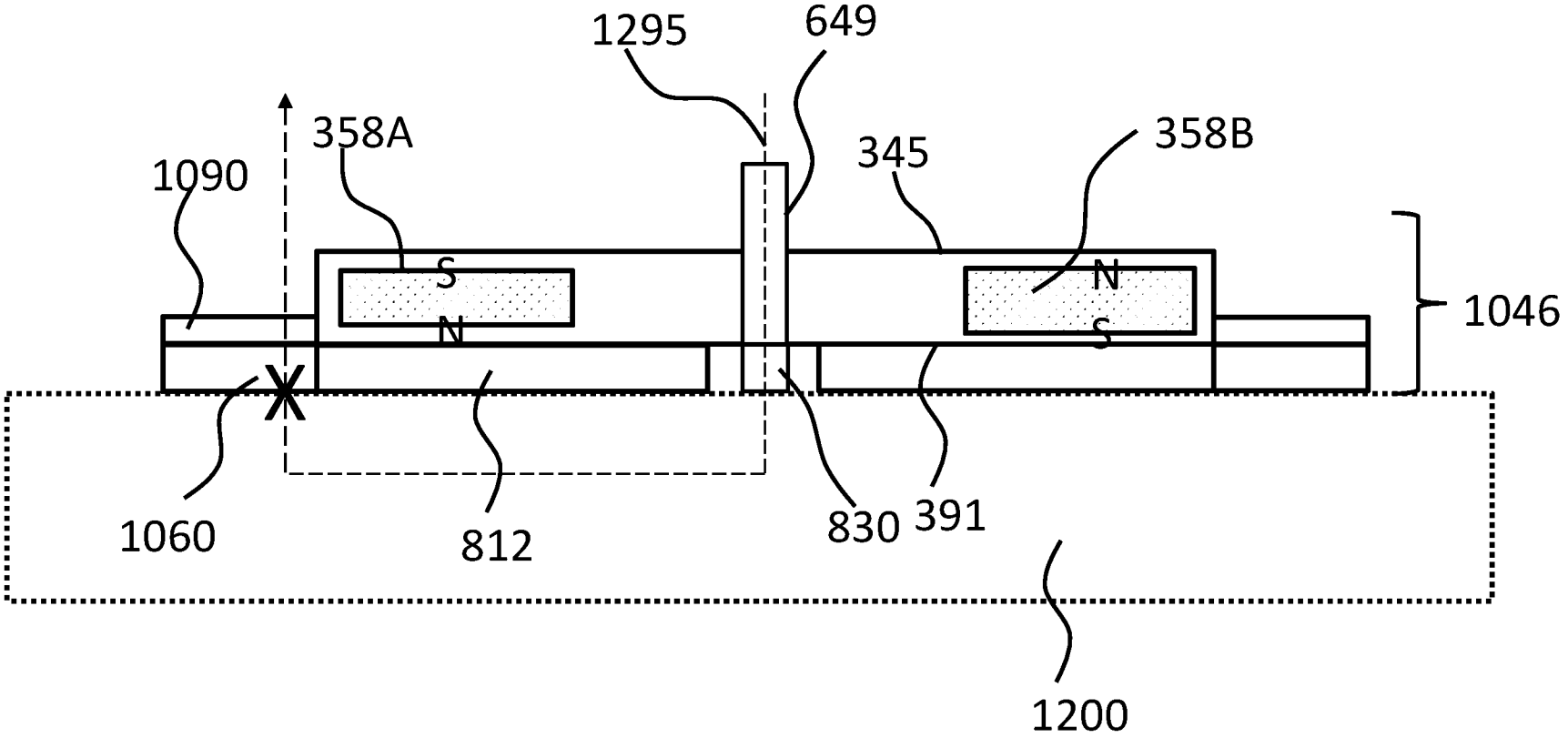

In this regard, FIG. 12 depicts an exemplary scenario where vibrational energy travels along a path 1295 from the actuator (not shown) of the removable component of the bone conduction device, along the structural component 646, through pad 1230, into skin 1200, then through skin 1200 (in this scenario, generally parallel to component 1212 which is connected to housing 345, as can be seen), and then out of skin 1200 (represented by a functional box, as can be seen) into the ambient air back towards the removable component of the bone conduction device (more specifically, a lateral side thereof). In an exemplary embodiment, this can have a deleterious effect in that the vibrational path 1295 can extend to a sound capture device, such as a microphone, located on the removable component of the bone conduction device, such as a lateral side thereof (e.g., on the side of the housing). This can result in feedback. In an exemplary embodiment, the embodiments of FIGS. 10 and 11 can reduce the effects of this scenario and/or eliminate the effects of the scenario. More particularly, FIG. 13A depicts an exemplary scenario of utilizing the skin interface assembly 1046, where the apparatus, including the plate 1090 and the pad 1060, blocks at least a portion of the vibrational energy traveling along path 1295 from extending out of the skin and into the air, and thus extending through the air to the sound capture device of the bone conduction device.

Thus, in an exemplary embodiment, there is a removable component of a bone conduction device that includes a vibrational barrier that extends, relative to a longitudinal axis of the first skin interface apparatus (axis 390), outward away from the first skin interface apparatus (e.g., 812) such that the barrier extends past microphone ports of the external component with respect to a direction normal to the longitudinal axis. This feature can be seen by superimposing the embodiment of FIG. 10 on the embodiment of FIG. 3B, where element 326 is the microphone of the removable component 340B.

In an exemplary embodiment, the structure 1090 and 1060 is a device that manages vibrations. The management of vibration resulting from the structure of 1090 and 1060 can utilize a variety of physical phenomena. More specifically, in an exemplary embodiment, there is a skin interface assembly, such as assembly 1010, that includes a third removable skin interface pad, in addition to the first and second removable skin interface paths, configured to at least one of dampen, reflect or diffuse transduction of vibrations generated by the drive apparatus transmitted through skin of the recipient. Any physical phenomenon that can be harnessed by the structure 1090 and 1062 that reduces the amount of vibrational energy that travels from the skin of the recipient back towards the removable component of the bone conduction device to a path that includes the air around the bone conduction device can be utilized in at least some exemplary embodiments.

Figure 13B:
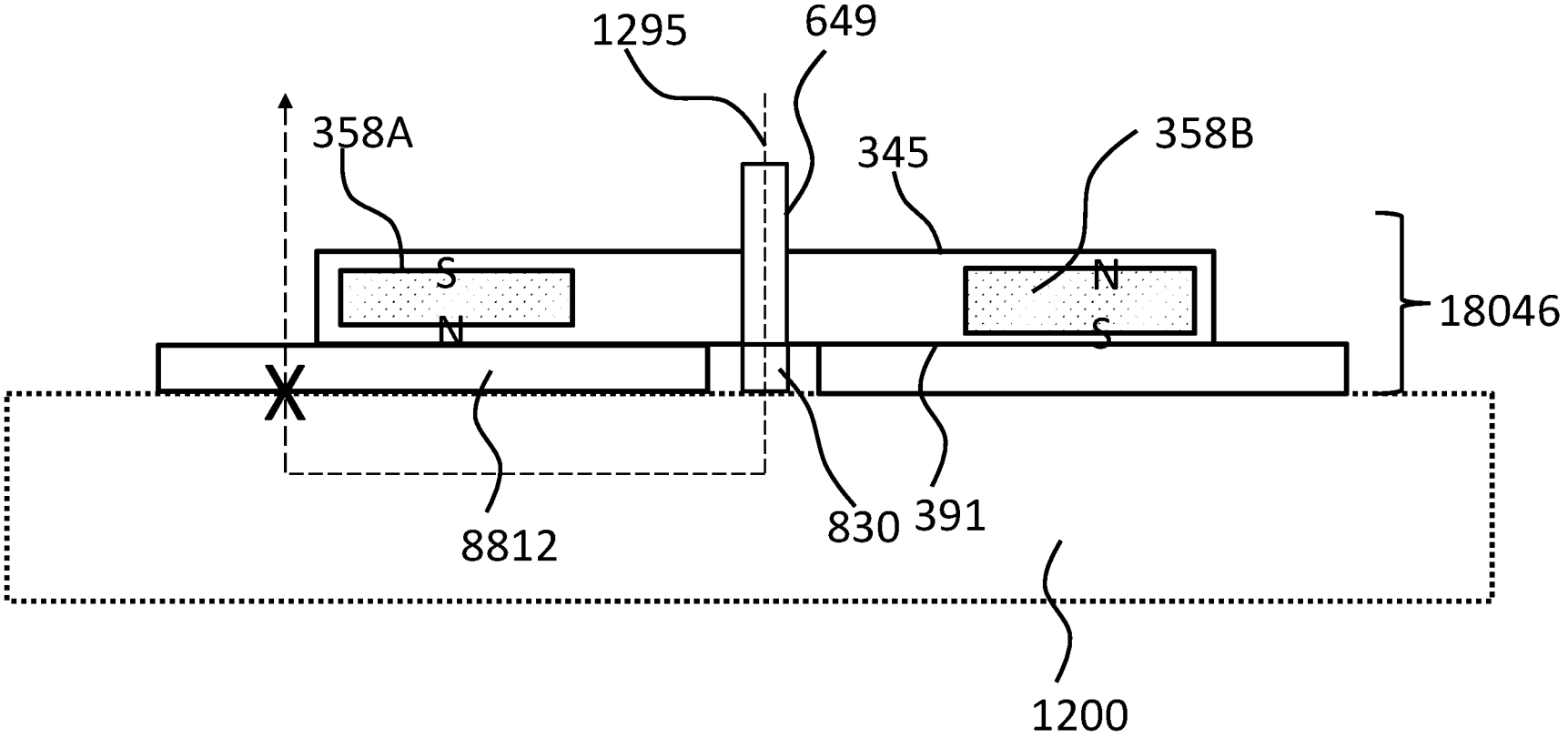

That said, some alternate embodiments are configured so that the pad of the support apparatus extends further outwards than some of the other embodiments, so as to be interposed between a path extending in a direction normal to the tangent surfaces of the skin to the microphone 326. In this regard, FIG. 13B depicts an alternate embodiment of a skin interface apparatus 18046 that includes a pad 8812 that extends out beyond the housing 345, as can be seen. Pad 8812 blocks the vibrational energy traveling along path numeral 1295, at least partially, from reaching the microphone. While the embodiment depicted in FIG. 13B depicts only the pad extending out beneath the location of the microphone (or the port(s) of the microphone(s)), in some alternate embodiments, the housing numeral 345 extends out beneath the location of the microphone (or ports). Still further, in an exemplary embodiment, the pad might not extend to the location beneath the location of the microphone ports, but the housing numeral 345 does extend to (and past) the location beneath the location of the microphone ports in this regard, the housing can serve as an air barrier to the vibrations traveling from the skin through the air to the microphone.

Figure 14:
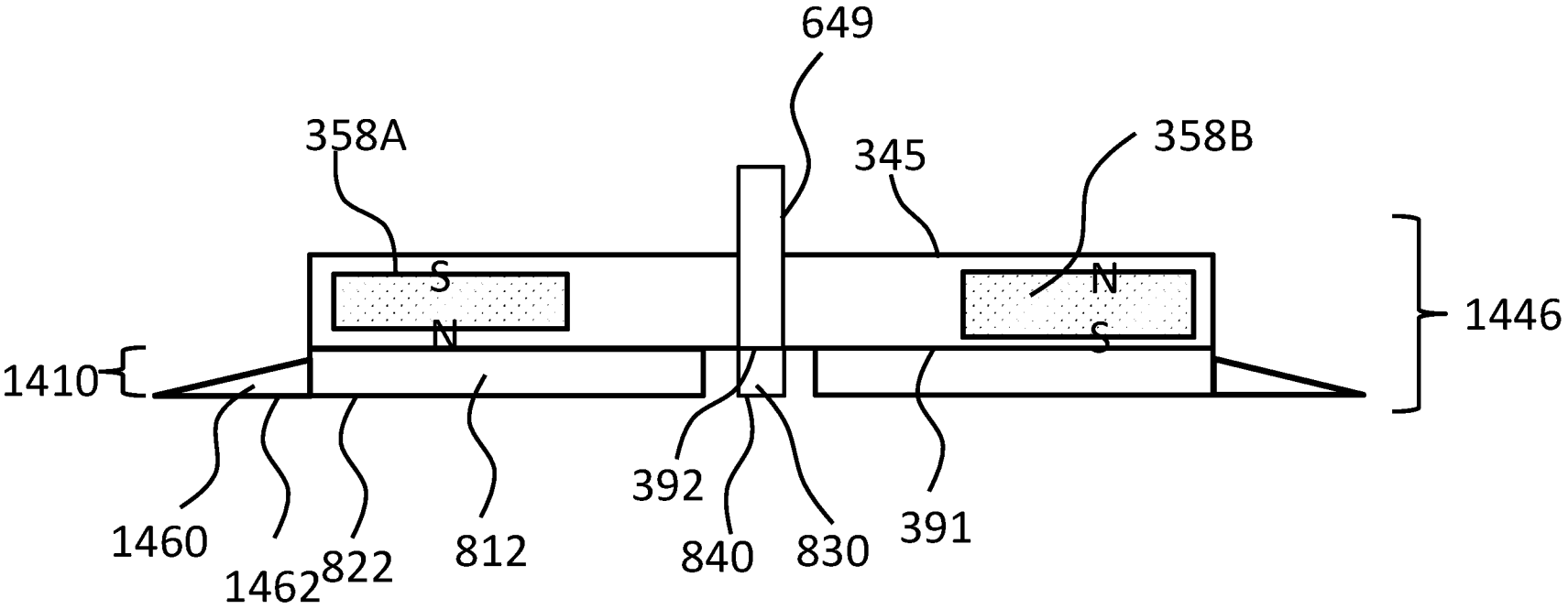
FIGS. 14-15 are schematic diagrams illustrating other exemplary skin interface assemblies according to some other exemplary embodiments.
Figure 15:
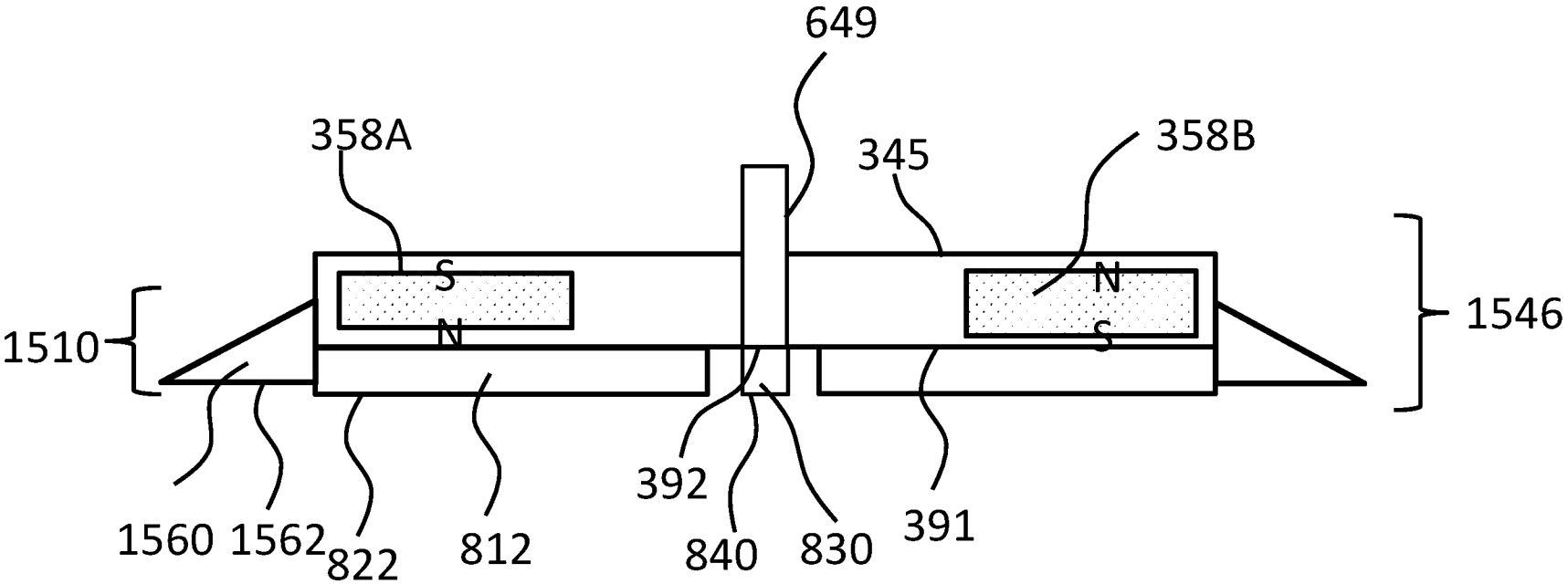

It is further noted that while the embodiments of FIGS. 10 and 11 depict a plate 1090 to which the pad 1060 and/or 1160 is attached, in an alternate embodiment, there is no plate. In this regard, pad 1060 and/or 1160 can extend from the pad 812 or other component to which the pad 1060 and/or 1160 any other pad is connected, either directly or in directly. In this regard, FIG. 14 depicts yet another alternate embodiment of a removable component 1446, which includes a third pad 1460 that extends about pad 822 and is in direct contact therewith. Collectively, pads 1460, 812, and 830 form a skin interface assembly 1410. As can be seen, the pad 1460 is self-supporting in that it is not connected to any back structure extending from the side of the housing 345, in contrast to the embodiment of FIG. 10. In the embodiment depicted in FIG. 14, surface 1462 of pad 1460 is configured to directly contacts skin of the recipient. That said, in an alternate embodiment, the pad 1460 can be positioned so that the surface 1462 does not come into contact with the skin of the recipient during normal operation. Along these lines, by way of example, FIG. 15 depicts another alternative embodiment of a skin interface assembly, skin interface assembly 1546, where the pads 1560 (which pads manage the vibrations in a manner analogous to pads 1060) extend up along the sides of the housing 345 (this embodiment depicts a bottom surface 1562 as being nonaligned with the bottom surface 822 of pad 812—in alternate embodiments, the bottom surface 1562 can be aligned with the bottom surface 822).

Thus, in view of the above, embodiments of exemplary skin interface assemblies can include a vibration management component (e.g., pad 1060), wherein the vibration management component is separate from the first skin interface apparatus (e.g., pad 812) and the second skin interface apparatus (e.g., pad 830).

As briefly noted above, the functionality of the vibration management component such that it at least one of dampens, reflects, or diffuses transduction of vibrations from the skin of the recipient. Again, this has utilitarian value in that it can reduce and/or eliminate feedback into the microphone of the bone conduction device. In this regard, in an exemplary embodiment, for a given use of a given bone conduction device, the vibration management component reduces the amount of transduction of vibrational energy that reaches the microphone (e.g., the vibration energy resulting from vibrations traveling along path numeral 1295) by at least 20%, 25%, 30%, 35%, 40%, 45%, 50%, 55%, 60%, 65%, 70%, 75%, 80%, 85%, 90%, 95%, or 100% relative to that which would be the case in the absence of the vibration management component, all other things being equal. In an exemplary embodiment, for a given use of a given bone conduction device where feedback occurs from a given output of the bone conduction device in the absence of the vibration management component, the vibration management component that eliminates the feedback, all of the things being equal.

It is noted that embodiments include the vibration management component when used with the pad 410 of FIG. 4B (i.e., the pad is a uniform pad without a discontinuity feature, for example, where pad 530 would otherwise be located).

Figure 19:
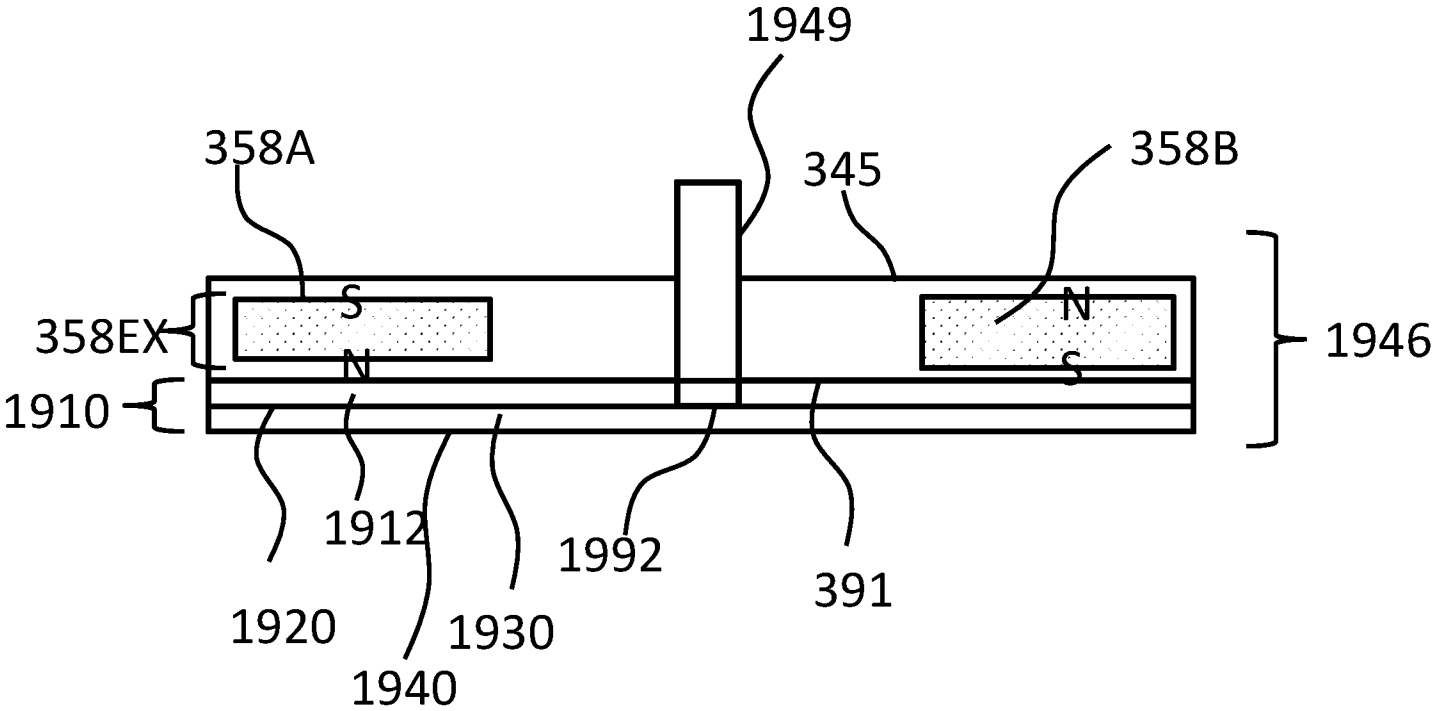
FIGS. 19 and 20 are schematic diagrams illustrating other exemplary skin interface assemblies according to some other exemplary embodiments.

FIG. 19 depicts another exemplary embodiment of a skin interface apparatus 1910 according to an exemplary embodiment. More specifically, skin interface assembly 1946 includes a skin interface apparatus 1910 that includes a first component 1930 that is configured to directly contact skin of the recipient, and a second component 1912 located relative to a side of the first component that is away from the skin of the recipient (e.g., at the surface 1920 of the second component 1912). In this exemplary embodiment, the first component is configured to absorb vibrations, and the second component is configured to reflect vibrations. As can be seen in the exemplary embodiment of FIG. 19, the structural component 1946 extends through the second component 1912 so as to be in contact with the first component 1930.

Figure 20:
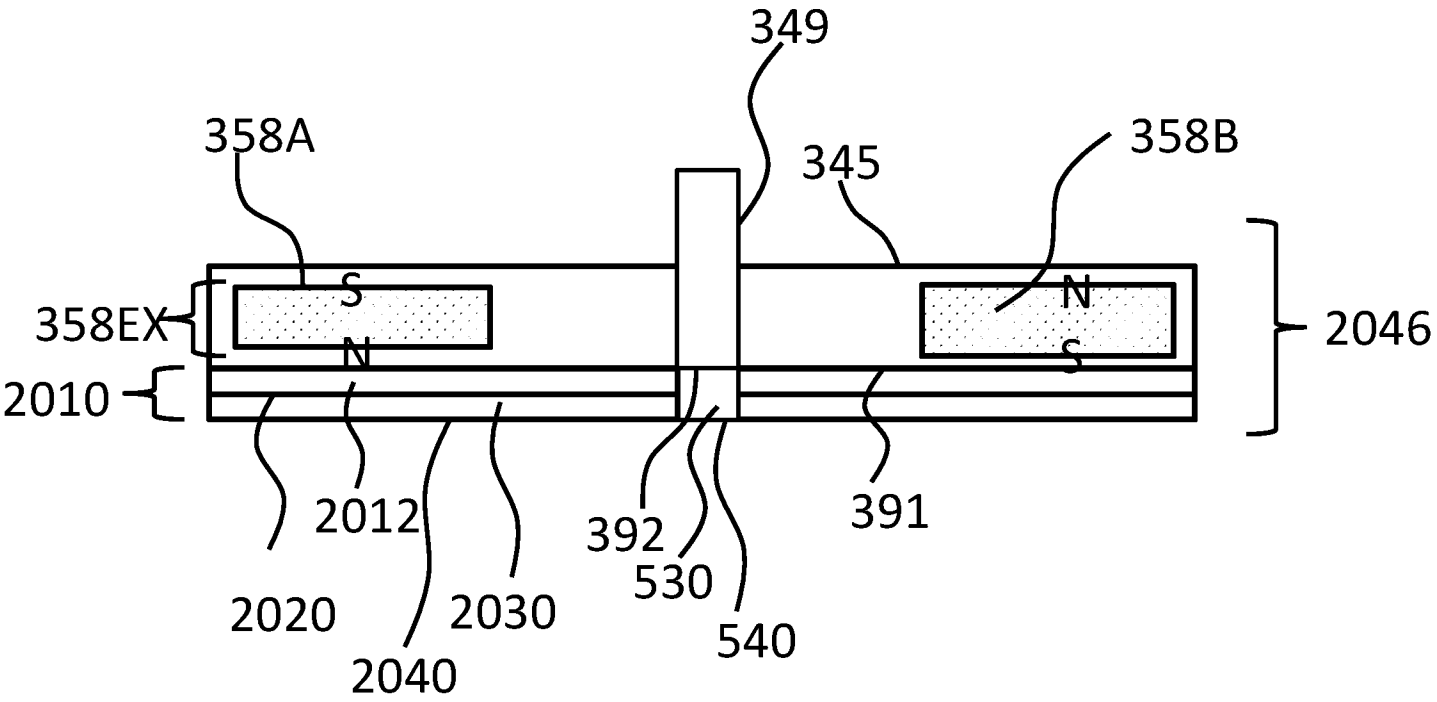

FIG. 20 depicts another exemplary embodiment of a skin interface apparatus 2010 according to an exemplary embodiment. More specifically, skin interface assembly 2046 includes a skin interface apparatus 2010 that includes a first component 2030 that is configured to directly contacts skin of the recipient, and a second component 2012 located relative to a side of the first component that is away from the skin of the recipient (e.g., at the surface 2020 of the second component 2012). In this exemplary embodiment, as is the case with respect to the embodiment of FIG. 19, the first component is configured to absorb vibrations, and the second component is configured to reflect vibrations. As can be seen, in the exemplary embodiment of FIG. 20, the pad 530 connected to the surface 392 of the structural component 349 extends through the first component 2030 and the second component 2012.

Any of the spatial arrangements detailed above with respect to the pad of the support assembly (e.g., pad 812) are applicable to components 1912, 1930, 2012, and 2030 or variations thereof. In an exemplary embodiment, components 1912 and 2012 are a metal plate, and components 1930 and 2030 are foam pads.

Figure 21:
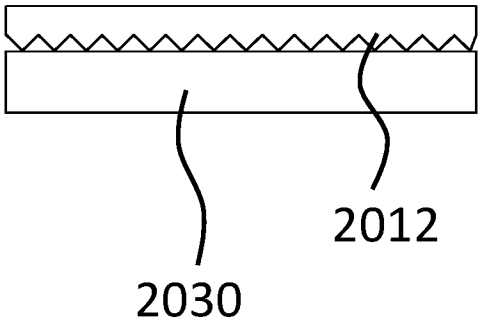
FIGS. 21 and 22 are schematic diagrams illustrating conceptual interface services between components of a skin interface apparatus according to an exemplary embodiment.
Figure 22:
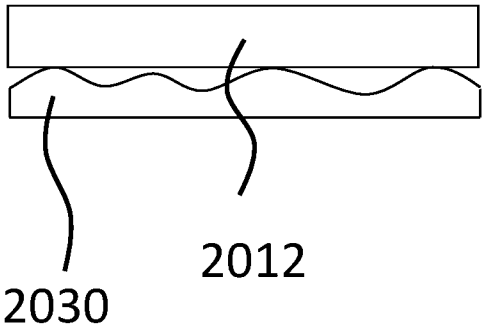
Figure 23:
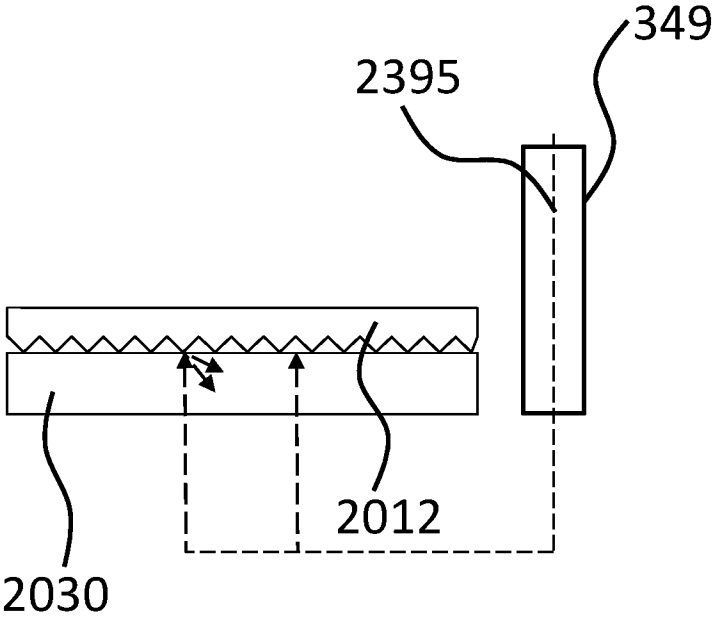
FIGS. 23 and 24 are schematic diagrams illustrating a path of vibrational energy according to some exemplary embodiments.
Figure 24:
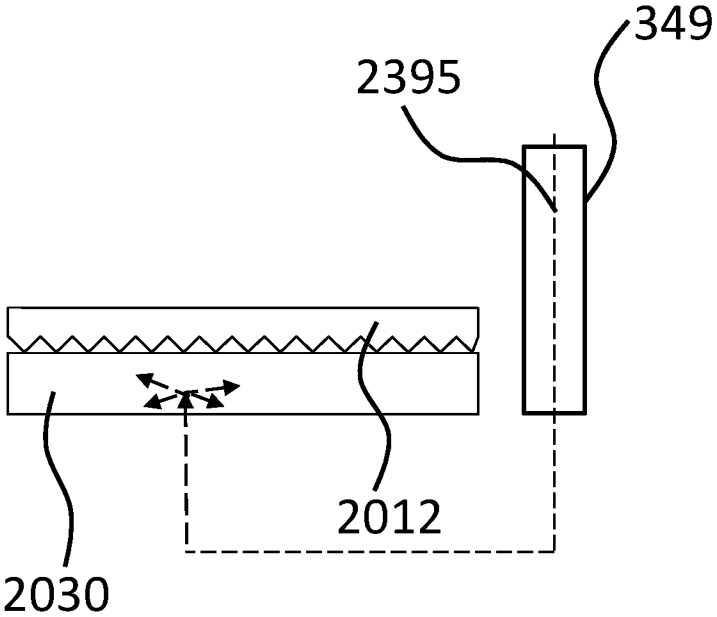

In an exemplary embodiment, the interface between the first component and the second component (e.g., at surface 1920 and 2020) is non-uniform. For example, at least one of a first face of the first component or a second face of the second component facing one another has a surface geometry that is non-planar. FIGS. 21 and 22 depict exemplary embodiments of this feature, where in FIG. 21, component 2012 has the non-planar face (and component 2030 has the planar face), and in FIG. 22, component 2030 has the non-planar face (and component 2012 has the planar face). In an exemplary embodiment, the non-planar face is configured to manage vibrations that travel from the skin back into the skin interface apparatus. In this regard, FIG. 23 depicts an exemplary scenario where vibrational energy travels along path 2395 from the actuator, through the structural component 349 and into skin of the recipient (not shown). The vibrational energy travels through the skin, and then upwards back towards the removable component of the bone conduction device, as represented by the legs of the path 2395. As can be seen, in some instances, the vibrations reach the interface between the component 2012 and the component 2030 where, owing to the discontinuities between the two components, there is an air gap that results in a change of medium through which the vibrations are not as conducive to transfer their across. Still further, in some instances, the vibrations reach the interface between the component 2012 and the component 2030, where, owing to the nonplanar features of, in this case, component 2012, the vibrational energy is deflected and/or reflected back away from component 2012 (in a manner analogous to how a RADAR wave is deflected from a surface of the F-117 Fighter—this as contrasted to the absorption of vibration, which occurs in other embodiments, which is analogous to how a RADAR wave is absorbed into a surface of the B-2 Bomber—this is represented in FIG. 24, where component 2030 is configured to absorb vibrations).

It is noted that in some embodiments, the component 2030 or 1930 is configured to absorb vibrations, and the component 1912 and 2012 are configured to reflect vibrations, in an alternate embodiment, the component 2030 or 1930 is configured to reflect vibrations, and the components 1912 and 2012 are configured to absorb vibrations. Any arrangement that can manage the transducted vibrations that travel back towards the removable component of the bone conduction device can be utilized in at least some exemplary embodiments.

In view of the above, it can be seen that in some exemplary embodiments, the first skin interface apparatus includes a first component (1930 or 2030) configured to directly contact the skin of the recipient and a second component (1912 or 2012) relative to a side of the first component that is away from the skin of the recipient, where at least one of a first face of the first component or a second face of the second component facing one another has a surface geometry configured to create diffuse vibrational reflections.

With respect to the embodiment of FIG. 20, it is noted that the pad 2030, the pad used towards the skin, can be made of or otherwise characterized as a skin friendly and/or soft material, configured to distribute the loading of the bone conduction device against the skin efficiently, and/or can be configured to absorb vibrations. Still further in this exemplary embodiment, it is noted that the pad 2012 can be a more rigid material, such as metal or the like, and can be a material which reflects vibrations and/or sound, at least more than that of the material of the pad 2030. In an exemplary embodiment, pad 2012 can be rigid, such as a rigid metal of the like. In an exemplary embodiment, the material of pad 2012 can have a higher density than that of the first pad 2030.

With respect to this embodiment, some configurations can have utilitarian value in that the combined assembly 1510 of the pad 1560, 812, and, optionally, 830, form a cup that "cups" around the housing 345 (or, in other terms, forms a boot that extends about housing 345). By sizing and dimensioning the interior of the cup of the assembly 1510 such that there is a slight interference fit when placed around the housing 345 (when the bottom portion of the housing 345 is plated into the interior of the assembly 1510), and optionally by utilizing elastic materials for at least a portion of the assembly 1510, the assembly 1510 can be self-adhering to the rest of the removable component 1546. That is, the assembly 1510 can be slipped onto and slipped off of the housing 345 to install and remove the assembly without any adhesive and/or without any structural components, the interference fit, with or without the elasticity features, adhering the assembly 15 density housing 345. Is further noted that this principle of adhering a skin interface apparatus to the housing can also be utilized without the additional features of pads 1560, etc. That is, in an exemplary embodiment, pad 812 can be configured to extend slightly past the outer boundaries of the housing 345, and upwards around the sidewalls of the housing 345, thus forming a hollow therein, that can cup the bottom portion of the housing. The pad 812 (and, if present, pad 830 or the analogous feature thereof) can be retained to the rest of the skin interface assembly via the slight interference fit and/or the elastic properties of the pad 822 as modified.

Figure 16:
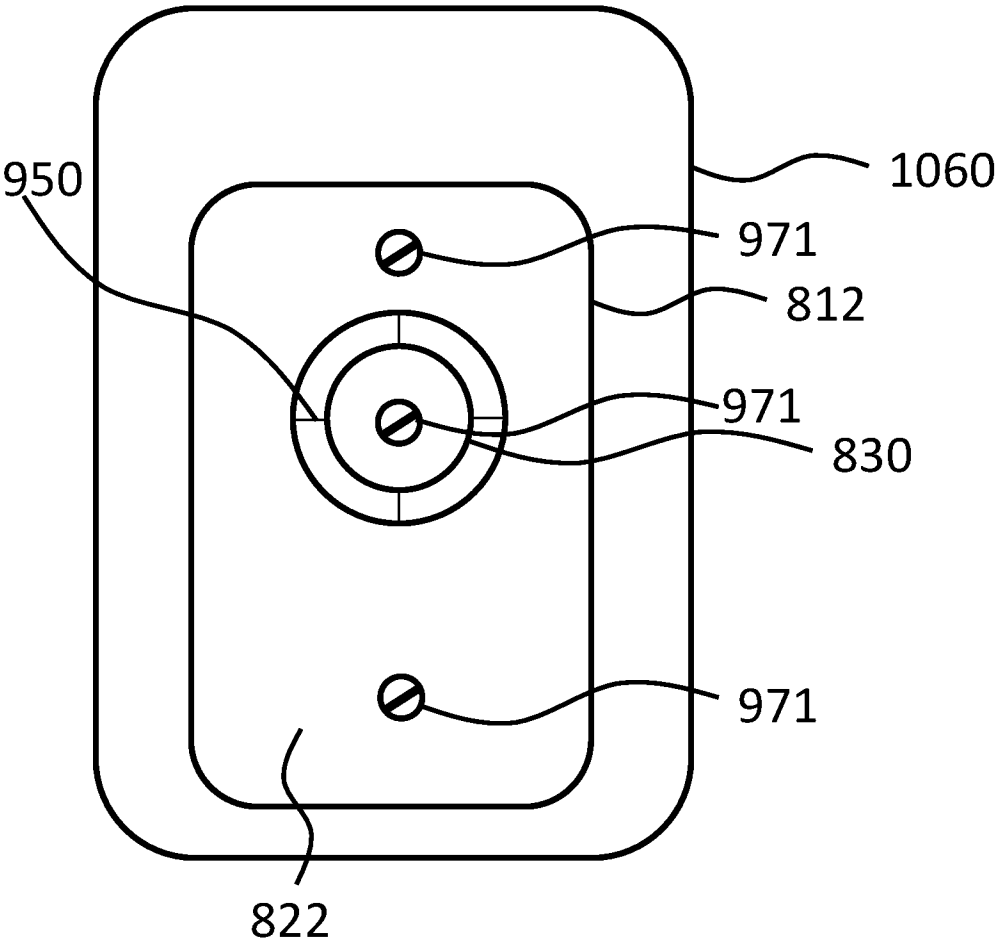
FIGS. 16-18 are bottom views of some exemplary skin interface apparatuses according to some exemplary embodiments.
Figure 17:
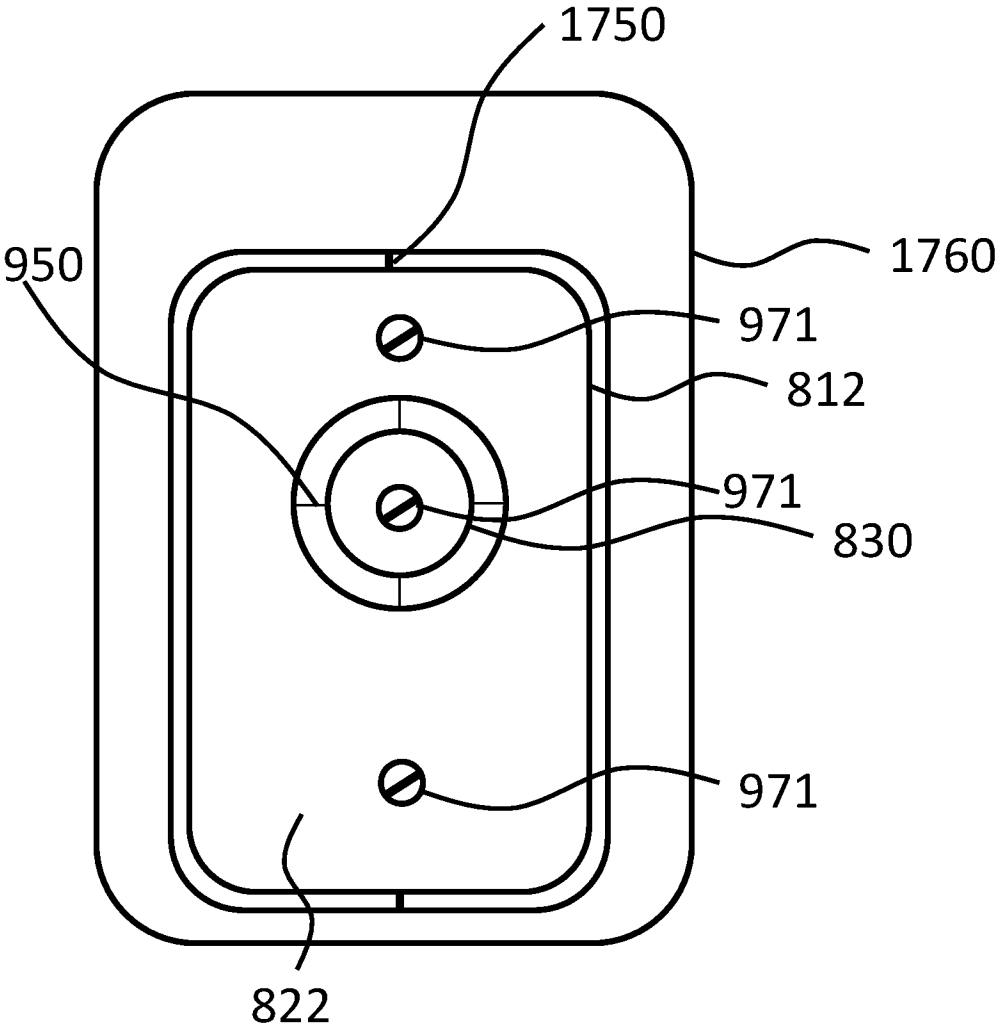

FIG. 16 depicts a view of the bottom of an alternate embodiment of FIG. 10. As can be seen, pad 1060 extends about pad 812. Here, pad 1060 is offset relative to a centroid of pad 812, but centered about the centroid of pad 830. In an exemplary embodiment, this can have utilitarian value with respect to the fact that pad 830 is offset relative to the centroid of pad 812, and thus the location of entrance of the vibrations into the skin of the recipient is also offset relative to pad 812. By centering the pad 1060 with the pad 830, pad 1060, which is utilized to manage the vibrations that travel from the skin of the recipient back towards the removable component of the bone conduction device, is centered about the location where the vibrations enter the skin of the recipient. FIG. 17 depicts a variation of the embodiment of FIG. 16, where a pad 760 is located offset and not in direct contact with pad 812. Instead, pad 1760 is loosely connected/loosely coupled to pad 812 via connector 1750, which can correspond at least in principle to the connector 950 detailed above.

Figure 18:
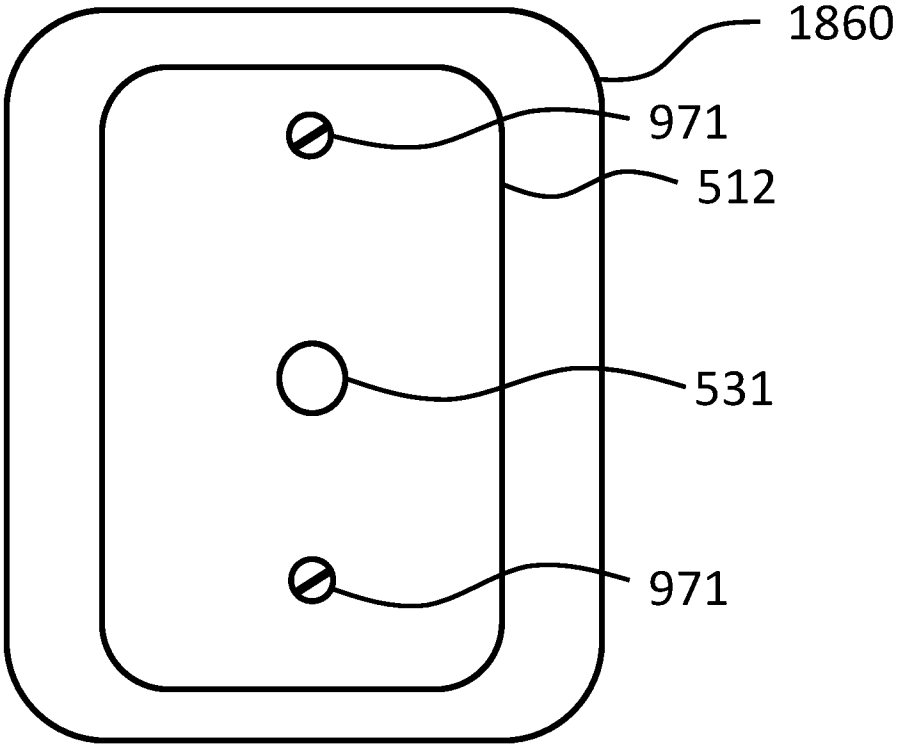

FIG. 18 depicts a bottom view of a variation of the embodiment of FIG. 5F, where a vibration management pad 1860 is directly connected to pad 512 which is directly connected to pad 531. It is noted that the embodiments of FIGS. 16-18 can have utilitarian value in that upon removal of fasteners 971, removal of pad 1860 will remove pads 512 and 531 along with pad 1860. Corollary to this is that when replacing the skin interface apparatus of the skin interface assembly (e.g., when such is utilitarian due to, for example, wear, due to the pads getting soiled, due to the pads emitting odor, etc.), the pads of a given skin interface apparatus can be placed on to the skin interface assembly as a single component, as opposed to having to place each pad individually on to the bone conduction device.

Accordingly, in an exemplary embodiment, there is a method that entails performing maintenance to a removable component of a bone conduction device, an exemplary embodiment, the method entails acquiring a bone conduction device including a skin interface assembly. The method further entails gripping a portion of a skin interface apparatus connected to the bottom of the skin interface assembly and removing the skin interface apparatus from the rest of the skin interface assembly. This removal action can be executed utilizing a pulling movement or a pushing movement, depending on the embodiment. In an exemplary embodiment, the skin interface apparatus corresponds to any one of the skin interface apparatuses disclosed herein, such as by way of example only and not by way of limitation, the skin interface apparatus 910 of FIG. 9A, where, at least in this embodiment, the pad 930 and the pad 912 are made of the exact same material and have the exact same properties, although in other embodiments, this is not the case (e.g., pad 930 is made of a different material than pad 912, etc.). Due to the connection between pad 930 and pad 912, the aforementioned pulling and/or pushing and/or sliding removes both the pad 930 and the pad 912 at the same time, even though the pad 930 is separated from the pad 912 by the space detailed above. Accordingly, by applying a removal force to only one of the pads, all of the pads can be removed at the same time. The maintenance method further includes obtaining a new skin interface apparatus 910, and placing the skin interface apparatus on to the bottom surface of the skin interface assembly in securing the new skin interface apparatus 910 thereto. In an exemplary embodiment, this action is executed by applying force only to the pad 912/gripping only the pad 912, and not contacting pad 930 (until pad 930 context structural component 649 or contacts another portion of the removable component of the bone conduction device—the idea here is that the user is not manipulating the pad 930 or otherwise touching the pad 930 with his or her hands). Accordingly, an exemplary embodiment can have utilitarian value with respect to changing two different pads at one time while only manipulating one of the pads.

It is further noted that in an exemplary embodiment, there is a skin interface apparatus, such as apparatus 910, which is configured to enable the above-noted method when utilized with a suitable skin interface assembly.

As can be seen from the bottom view of the figures, the surface area of the pad that is directly connected to the structural component that transmits vibrations from the actuator (e.g., surface 540) is much lower than the surface area of the pad that is directly connected to the housing of the skin interface assembly (e.g., surface 822). In an exemplary embodiment, the surface areas facing and/or in contact with the skin (or configured to contact the skin during normal use of the bone conduction device) of the pad of the support assembly (e.g., pad 812) is at least 2, 3, 4, 5, 6, 7, 8, 9, 10, 11, 12, 13, 14, 15, 16, 17, 18, 19 or 20 times that of the pad of the driver assembly (e.g., pad 531).

Figure 25:
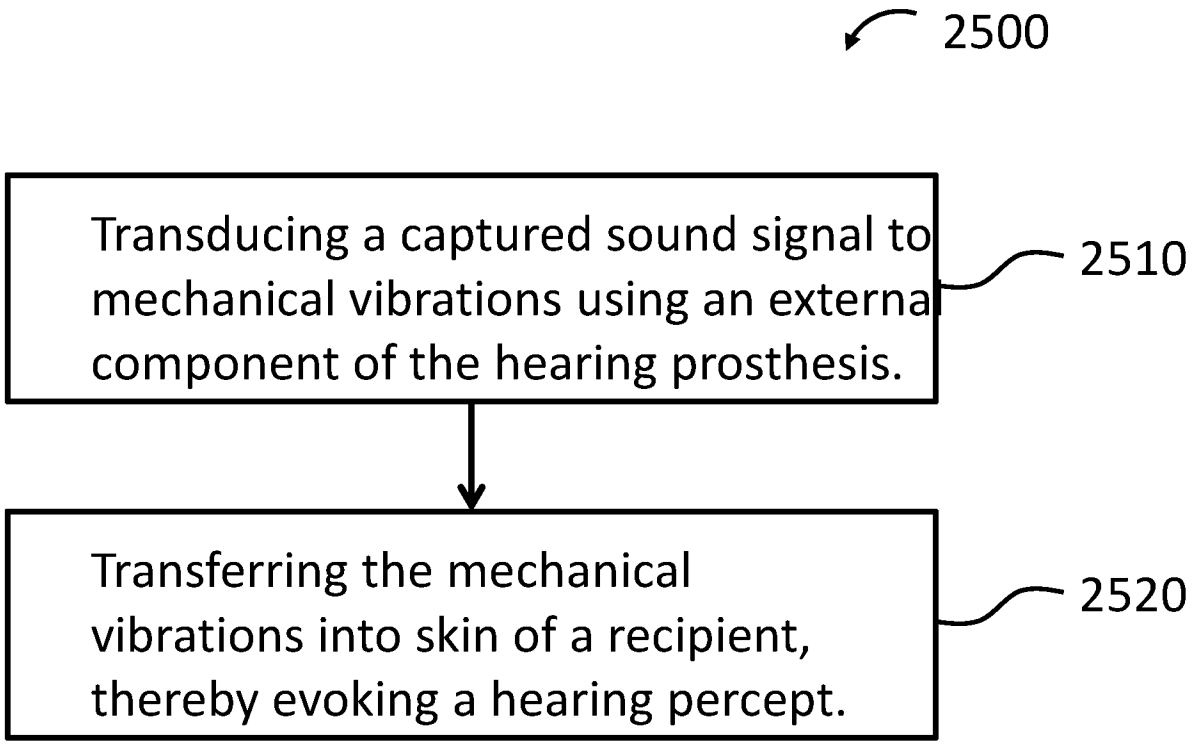
FIG. 25 depicts an exemplary flowchart for an exemplary method according to an exemplary embodiment.

It is noted that some exemplary embodiments include methods. In this regard, FIG. 25 presents an exemplary algorithm 2500 for an exemplary method. Here, method 2500 includes method action 2510, which entails transducing a captured sound signal into mechanical vibrations using an external component of the hearing prosthesis (e.g., the process that occurs when the signal from microphone 326 is used to actuate the actuator 342A or 342B). Method 2500 further includes method action 2520, which entails transferring the mechanical vibrations into skin of a recipient, thereby evoking a hearing percept. In this exemplary embodiment, a path of transducer vibrations (that evoke the hearing percept in at least some embodiments) travels from the external component into the skin through a first surface that has a different characteristic than a second surface supporting the external component on the skin. By way of example only and not by way limitation, the surfaces can be surfaces 540 and 522 of FIG. 5A, 540 and 522 of FIG. 5B, 540 and 522 of FIG. 5C, 544 and 522 of FIG. 5F, 692 and 622 of FIGS. 6, 692 and 722 of FIGS. 7A and 7B, 840 and 822 of FIGS. 8, 940 and 922 of FIG. 9A, etc.

It is noted that owing to the fact that the removable component of the bone conduction devices are, at least in some embodiments, constructed and arranged such that at least some vibrations will travel through the housing 345 to the associated pad (e.g., pad 512, 812, etc.) or other pertinent skin interface component, despite the fact that there is utilitarian value, in at least some embodiments, with respect to channeling most, if not all, of the vibrational energy generated by the actuator through the structural component (e.g., 349) to the skin of the recipient (e.g., through pad 530) while bypassing the other skin interface component (e.g., pad 512). Accordingly, in an exemplary embodiment, the amount of vibrational energy that is generated by the actuator that passes through the first surface (e.g., surface 540) as compared to the total amount that passes from the combined skin interface surfaces (e.g., the total that passes through surface 522 plus 540, or the total that passes through surface 840 plus 822 plus 1062) into skin of the recipient is at least 65%, 70%, 75%, 80%, 85%, 86%, 87%, 88%, 89%, 90%, 91%, 92%, 93%, 94%, 95%, 96%, 97%, 98%, or at least 99%, or can be 100% in some embodiments.

In some exemplary embodiments, the aforementioned second surface 822 is more flexible than the aforementioned first surface (540). By way of example, the second surface is at least 50%, more flexible, 75% more flexible, 100% flexible, 125% more flexible, 150% more flexible, 175% more flexible, 200% more flexible, 250% more flexible, 300% more flexible, 350% more flexible, 400%, more flexible, 450% more flexible, 500% more flexible, or more, than the first surface.

In an exemplary embodiment, first vibrations transferred to the skin travel generally parallel to the surface of the skin away from the location of entry into the skin, and the second surface at least one of reflects, diffuses or dampens a subset of the first vibrations that travel back towards the external component. In this regard, this corresponds to the phenomenon depicted in FIG. 23. Corollary to this, is that in some embodiments, at least a subset of the vibrations transferred to the skin result in transduction of vibrations from the skin, and an amount of vibrational energy from the transduction of vibrations that travel to a microphone of the external component is lower than that which would be the case if the second surface had the same characteristics as the first surface. In this regard, this corresponds to the phenomenon depicted in FIG. 13A. In an exemplary embodiment, the amount of vibrational energy that reaches the microphone relative to that which reaches the microphone in the absence of the vibration management component is at least 30% lower, 35%, 40%, 45%, 50%, 55%, 60%, 65%, 70%, 75%, 80%, 85%, 86%, 87%, 88%, 89%, 90%, 91%, 92%, 93%, 94%, 95%, 96%, 97%, 98% or 99% lower, or can be 100% lower in some embodiments.

Figure 26:
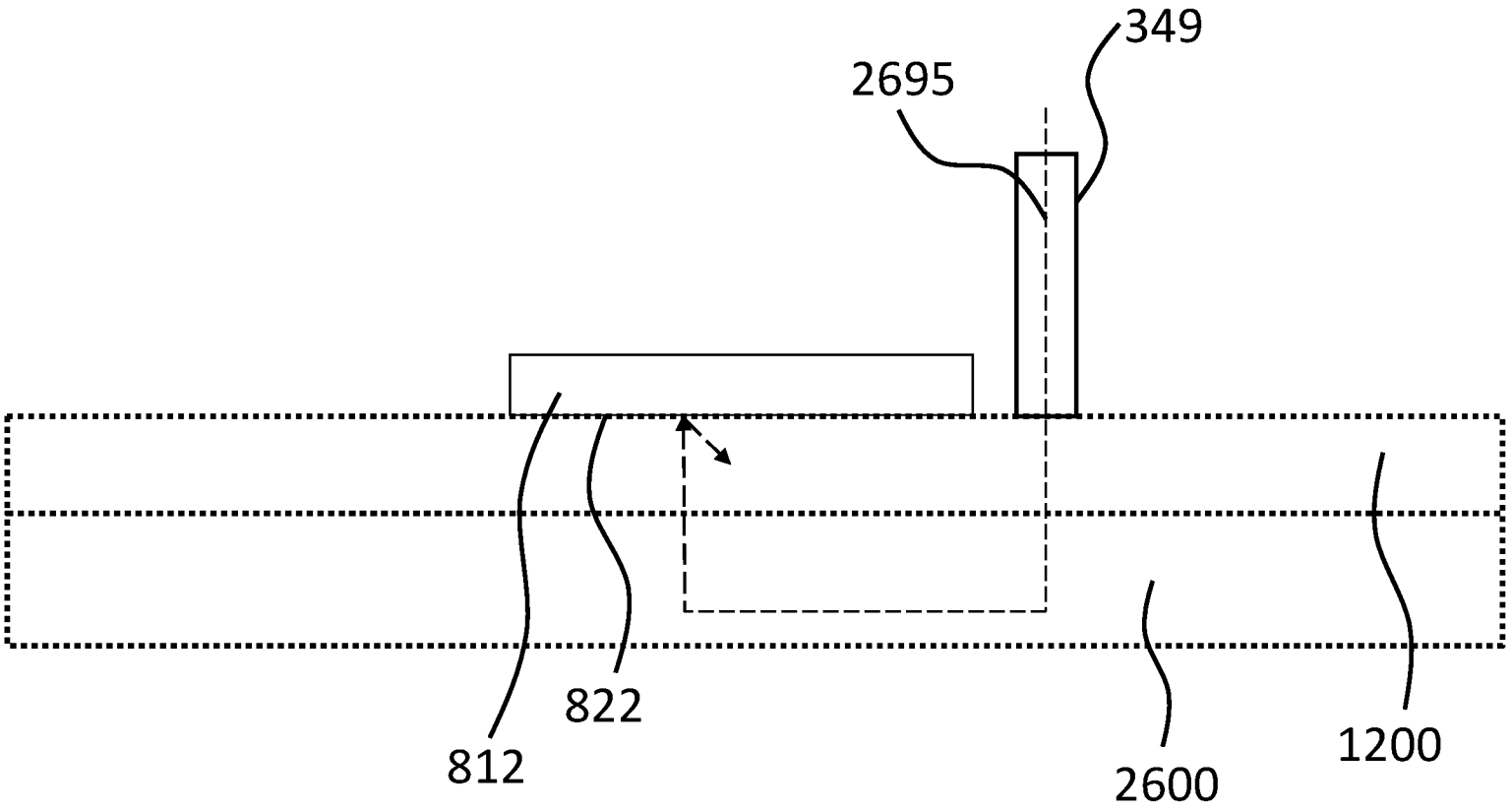
FIG. 26 is a schematic diagram illustrating a path of vibrational energy according to another exemplary embodiment.

In an exemplary embodiment, at least a subset of the vibrations transferred to the skin result in vibrations that travel through the skull of the recipient, and at least a subset of the vibrations that travel through the skull travel from skull through the skin and to the aforementioned second surface, and the second surface reflects at least a portion of the vibrations that travel through the skin to the second surface. FIG. 26 depicts a functional representation of this, where path 2695 extends through the skin 1200 into the skull 2600. In an exemplary embodiment, the second surface reflects at least 25%, 30%, 35%, 40%, 45%, 50%, 55%, 60%, 65%, 70%, 75%, 80%, 85%, 86%, 87%, 88%, 89%, 90%, 91%, 92%, 93%, 94%, 95%, 96%, 97%, 98% or 99% or more of the vibrations that reach that surface via path 2695.

In an exemplary embodiment, the aforementioned reflection reduces and/or eliminates feedback relative to that which would be the case in the absence of the aforementioned reflective capability.

Figure 27:
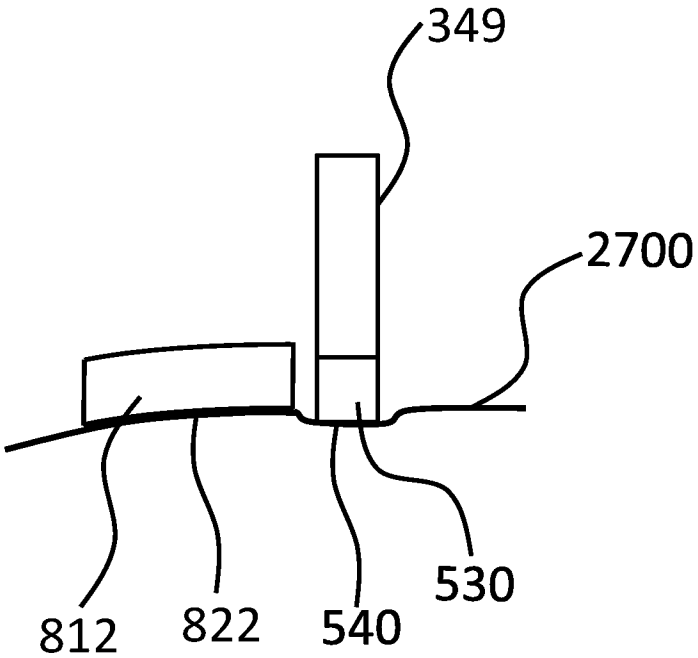
FIG. 27 is a schematic diagram illustrating a symbol of operation of an exemplary skin interface apparatus according to an exemplary embodiment.

In an exemplary embodiment, at least a subset of the vibrations transferred to the skin result in vibrations that travel through the skull of the recipient, and at least a subset of the vibrations that travel through the skull travel from skull through the skin and to the second surface, and a third surface (e.g., surface 1062), separate from the second surface (e.g., 822) and the first surface (e.g., 840) at least one of reflects, diffuses or dampens a subset of the first vibrations that travel back towards the external component. In this regard, this can occur at the "X" depicted in FIG. 12 (where FIG. 12 does not depict the skull portion). In an exemplary embodiment, the second surface has self-conformed to the surface of the skin more than the first surface at the time of the transduction of the sound. FIG. 27 depicts this by way of example, where surface 822 has conformed to the skin 2700 (and also compressed), and the surface 540 has conformed less (in embodiments where the surface is simply the end of the structural component 349, there is no conforming. In an exemplary embodiment, on a per-unit area basis, the second surface has conformed (and is configured to conform), based on a given stress applied to the surfaces, from a perfectly flat reference plane, 25%, 30%, 35%, 40%, 45%, 50%, 55%, 60%, 65%, 70%, 75%, 80%, 85%, 90%, 95%, 100%, 110%, 120%, 130%, 140%, 150%, 160%, 170%, 180%, 190%, 200%, 225%, 250%, 275%, 300%, 325%, 350%, 400%, 500%, 600%, 700%, 800%, 900% or 1000% or more, than the first surface.

Moreover, in an exemplary embodiment, where a first pad portion made of an compressible material or otherwise has compressible characteristics, and the second pad portion is made of a non-compressible material or otherwise has non-compressible characteristics, the first pad portion can be thicker (e.g., the diameter thereof in a direction of the longitudinal axis 390 of the device) than the second pad portion. In an exemplary embodiment, the difference in thickness is such that the compression of the first pad portion when applied against the skin of the recipient results in the bottom surfaces (the skin interfacing surfaces) of the pads being level with each other. That said, such difference in thickness can be provided where both pads are compressible or where both pads are incompressible, in a scenario where a preload is desired (e.g., of the drive component), etc. Note further that the above compressibility/incompressibility features can be relative to one another. That is, the first pad and the second pad can be compressible, but the first pad can be relatively more compressible (e.g., more than 1.5 times, more than 2 times, more than 2.5 times, more than 3 times, more than 3.5 times, more than 4 times, more than 5 times, more than 6 times, more than 7 times, more than 8 times, more than 9 times or more than 10 times or more) than the second pad.

As noted above, the various skin interface components detailed herein are made of different materials. With reference to FIGS. 5A-5D, in an exemplary embodiment, there is a skin interface assembly, such as pad assembly 510A or 510C (or any of the other pad assemblies detailed herein, or any other interface components herein) for an external component of a passive bone conduction device (e.g., any of components 340A and 340B, comprising a first pad portion configured to interface with skin of the recipient (e.g., portion 512), and a second pad portion configured to interface with skin of the recipient (e.g., portion 530), wherein the first pad portion is made of different material than the second pad portion. By "made of," it is meant that the component at issue is at least 50.1% by weight of the material at issue (not including impurities). In an exemplary embodiment, the component at issue is at least 60%, 70%, 80%, 90%, or 100% by weight constructed of the material at issue (not including impurities).

In an exemplary embodiment, the first pad portion 512 (or any other portion detailed herein) is made of a visco-elastic polymer and the second pad portion 530 (or any other portion detailed herein is made of a material that is less elastic than the first pad portion). In an exemplary embodiment, the first pad portion is made of a soft sponge material. In an exemplary embodiment, the first pad portion is made of a pseudoplastic material. In an exemplary embodiment, the first pad portion is made of a foam. In an exemplary embodiment, the second pad portion is made of a memory foam having a vibrational transmissivity greater than the first pad portion. In an exemplary embodiment, the second pad portion is made of a dilatant material.

In an exemplary embodiment, the aforementioned first pad portion (or first skin interface portion), is made of an adhesive, a soft porous sponge, a gel, a pseudoplastic material (such as, for example, a thixotropic material), a material that results in an increase in dampening while also resisting collapse under static pressure, a viscoelastic polymer, rubber, neoprene, silicone, a foam (polyurethane foam, silicone foam), a soft closed air cell foam, or metal (alloy, composite material, etc.). In an exemplary embodiment, the aforementioned second pad portion (or second skin interface portion) is made of a memory foam, a dilatant material, a material that is stiffer than the material of the first pad portion, an adhesive, a gel, a material that hardens after application, such as the material utilized for an ear mould impression or metal (alloy, composite material, etc.).

In an exemplary embodiment, the first pad portion and/or the second pad portion can be made of dilatant material, rheopectic materials and/or slow recovery memory foam materials. Low density memory foams and/or high density memory foams can be utilized. Viscoelastic memory foams with a variety of different density, tensile strength, elongation, porosity and other properties are available and can be used in practicing various embodiments.

In an exemplary embodiment, the first pad portion and/or the second pad portion can correspond in construction and/or in use to the pad disclosed in U.S. Patent Application Publication No. 2014/0233765, filed on Feb. 15, 2013, at the USPTO, naming Dr. Marcus Andersson as an inventor, or any other arrangement therein.

It is also noted that in at least some alternate embodiments, the component at issue is at less than 50.1% by weight of the material at issue (not including impurities). That is, while it is not considered to be made of the material, it includes the material.

Any material in any combination that can enable the teachings detailed herein and/or variations thereof to be practiced can be utilized in at least some embodiments.

It is noted that any disclosure of any method action or method or system herein corresponds to a disclosure of a device configured to effect that method action, method, or system. Still further, it is noted that any disclosure of any device disclosed herein corresponds to a disclosure of utilizing that device, including a disclosure of utilizing the device and a method of evoking a hearing percept, or at least enabling the evocation of a hearing percept. It is also noted that any disclosure of any method actions of making a device corresponds to a disclosure of the resulting device made by those method actions, and that any disclosure of any device herein corresponds to a disclosure of a method of making that device, in whole or in part.

Note further that any teachings detailed herein can be combined with any other teaching detailed herein, unless otherwise specified, providing that such will enable utilitarian results.

While various embodiments have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. A skin interface apparatus configured as an interface of a prosthesis with skin of a recipient, comprising:

at least one permanent magnet configured to magnetically retain the skin interface apparatus to the skin via interaction with an implanted magnet implanted beneath the skin of the recipient;

a first portion configured for direct contact with skin of the recipient; and a second portion configured for direct contact with skin of the recipient, wherein the portions have different material properties, the skin interface apparatus is configured to support the magnet such that the magnet is spaced away from the skin of the recipient, and the first portion has a surface area that interfaces with the skin of the recipient that is at least three times that of the second portion.

2. The skin interface apparatus of claim 1, wherein:

the first portion is softer than the second portion; and the skin interface apparatus is configured such that the first portion supports the prosthesis in the absence of the second portion.

3. A removable component of a passive transcutaneous bone conduction device, comprising:

an actuator; and a skin interface apparatus configured as an interface of a prosthesis with skin of a recipient, including:

at least one permanent magnet configured to magnetically retain the skin interface apparatus to the skin via interaction with an implanted magnet implanted beneath the skin of the recipient;

a first portion configured for direct contact with skin of the recipient; and a second portion configured for direct contact with skin of the recipient, wherein the portions have different material properties, the skin interface apparatus is configured to support the magnet such that the magnet is spaced awayfrom the skin of the recipient, and the first portion surrounds the second portion.

4. The removable component of a passive transcutaneous bone conduction device of claim 3, wherein:

the first portion is a part of a holding plate pad of a hearing prosthesis and the second portion is part of a driving plate pad of the hearing prosthesis.

5. The removable component of a passive transcutaneous bone conduction device of claim 3, wherein:

the first portion is elastically different than the second portion.

6. A skin interface apparatus configured as an interface of a prosthesis with skin of a recipient, comprising:

at least one permanent magnet configured to magnetically retain the skin interface apparatus to the skin via interaction with an implanted magnet implanted beneath the skin of the recipient;

a first portion configured for direct contact with skin of the recipient; and a second portion configured for direct contact with skin of the recipient, wherein the portions have different material properties, the skin interface apparatus is configured to support the magnet such that the magnet is spaced away from the skin of the recipient, the first portion is configured to transfer vibrations therethrough at a first transmissibility value, and the second portion is configured to transfer vibrations therethrough at a second transmissibility value substantially higher than the first transmissibility value.

7. A skin interface pad assembly for an external component of a passive bone conduction device, comprising:

a first pad portion configured to interface with skin of the recipient; and a second pad portion configured to interface with skin of the recipient, wherein the first pad portion is made of different material than the second pad portion, a first surface area of the first pad comprising the surface that interfaces with skin of the recipient of the first pad is larger than a second surface area of the second pad comprising the surface that interfaces with skin of the recipient, and the first pad portion is made of a visco-elastic polymer and the second pad portion is made of a material that is less elastic than the first pad portion.

8. The skin interface pad assembly of claim 7, wherein:

the pads are not in contact with magnetic material.

9. The skin interface pad assembly of claim 7, wherein:

the skin interface pad assembly is devoid of any plate component that contacts the pads.

10. A skin interface pad assembly for an external component of a passive bone conduction device, comprising:

a first pad portion configured to interface with skin of the recipient; and a second pad portion configured to interface with skin of the recipient, wherein the first pad portion is made of different material than the second pad portion, a first surface area of the first pad comprising the surface that interfaces with skin of the recipient of the first pad is larger than a second surface area of the second pad comprising the surface that interfaces with skin of the recipient, and at least one of:

the first pad portion is made of a pseudoplastic material, the first pad portion is made of a soft sponge material, or the second pad portion is made of a dilatant material.

11. The skin interface pad assembly of claim 10, wherein:

the first pad portion is made of the soft sponge material.

12. The skin interface pad assembly of claim 10, wherein:

the second pad portion is made of the dilatant material.

13. The skin interface pad assembly of claim 10, wherein:

the first pad portion is made of the pseudoplastic material.

14. A skin interface pad assembly for an external component of a passive bone conduction device, comprising:

a first pad portion configured to interface with skin of the recipient; and a second pad portion configured to interface with skin of the recipient, wherein the first pad portion is made of different material than the second pad portion, a first surface area of the first pad comprising the surface that interfaces with skin of the recipient of the first pad is larger than a second surface area of the second pad comprising the surface that interfaces with skin of the recipient, and the first pad portion is made of a foam.

15. The skin interface pad assembly of claim 14, wherein:

the second pad portion is made of a memory foam having a vibrational transmissivity greater than the first pad portion.

16. A removable component of a bone conduction device, comprising:

a first skin interface apparatus configured to serve as an interface between a support apparatus of the device and skin of a recipient; and a second skin interface apparatus configured to serve as an interface between a vibratory apparatus of the device and skin of the recipient, wherein the skin interface apparatuses are different, the first skin interface apparatus is an elastic pad, and the second skin interface apparatus is a metallic component.

17. The component of claim 16, wherein:

the first skin interface apparatus is configured to dampen vibrations more than the second skin interface apparatus.

18. The component of claim 16, further comprising:

a vibration management component, wherein the vibration management component is separate from the first skin interface apparatus and the second skin interface apparatus, and the vibration management component is configured to at least one of dampen or reflect or diffuse vibrations transducted from the skin of the recipient.

19. The component of claim 16, wherein:

a vibrational barrier extends, relative to a longitudinal axis of the first skin interface apparatus, outward away from the first skin interface apparatus such that the barrier extends past microphone ports of the external component with respect to a direction normal to the longitudinal axis.

20. The component of claim 16, wherein:

the first skin interface apparatus is only indirectly connected to the second skin interface apparatus and the first and second skin interface apparatuses are the only portions that contact the skin; and the first skin interface apparatus is softer than the second skin interface apparatus.

* * * * *